US008986914B2

(12) United States Patent
Fujikawa et al.

(10) Patent No.: US 8,986,914 B2
(45) Date of Patent: Mar. 24, 2015

(54) TONER

(75) Inventors: Hiroyuki Fujikawa, Yokohama (JP); Kunihiko Nakamura, Gotemba (JP); Nozomu Komatsu, Mishima (JP); Yoshiaki Shiotari, Mishima (JP); Koh Ishigami, Mishima (JP); Kentaro Kamae, Yokohama (JP); Takayuki Itakura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 1 day.

(21) Appl. No.: 13/822,613

(22) PCT Filed: Sep. 15, 2011

(86) PCT No.: PCT/JP2011/071763

§ 371 (c)(1),
(2), (4) Date: Mar. 12, 2013

(87) PCT Pub. No.: WO2012/036311

PCT Pub. Date: Mar. 22, 2012

(65) Prior Publication Data

US 2013/0171556 A1 Jul. 4, 2013

(30) Foreign Application Priority Data

Sep. 16, 2010 (JP) ..... 2010-207923

(51) Int. Cl.
*G03G 9/08* (2006.01)
*G03G 9/087* (2006.01)

(52) U.S. Cl.
CPC ..... *G03G 9/08755* (2013.01); *G03G 9/081* (2013.01); *G03G 9/0821* (2013.01); *G03G 9/08782* (2013.01); *G03G 9/08795* (2013.01); *G03G 9/08797* (2013.01)
USPC ..... 430/109.4

(58) Field of Classification Search
CPC ..... G03G 9/08755
USPC ..... 430/109.4
See application file for complete search history.

(56) References Cited

U.S. PATENT DOCUMENTS 5,968,701 A 10/1999 Onuma et al.
6,020,102 A 2/2000 Fujimoto et al.

(Continued)

FOREIGN PATENT DOCUMENTS

EP 0 974 871 A1 1/2000
JP 11-305486 A 11/1999

(Continued)

OTHER PUBLICATIONS

PCT International Search Report and Written Opinion of the International Searching Authority, International Application No. PCT/JP2011/071763, Mailing Date Nov. 8, 2011.

(Continued)

*Primary Examiner* — Mark A Chapman
(74) *Attorney, Agent, or Firm* — Fitzpatrick, Cella, Harper and Scinto

(57) ABSTRACT

An object of the present invention is to improve resistance to wraparound during fixing while achieving both low-temperature fixability and resistance to hot offset. A further object is to suppress image density variations and fogging in white background regions during use at high print coverage rate at high temperature and high humidity. A toner containing inorganic fine particles and toner particles containing a binder resin and a wax being provided, the toner being characterized in that the binder resin contains a polyester resin A obtained by condensation polymerization of a polyvalent carboxylic acid and an alcohol component mainly containing an aromatic diol and a polyester resin B obtained by condensation polymerization of a polyvalent carboxylic acid and an alcohol component mainly containing an aliphatic diol, and in that the degree of segregation of the wax in the toner depth direction from the toner surface toward the toner center is controlled.

5 Claims, 1 Drawing Sheet

(56) References Cited

U.S. PATENT DOCUMENTS

| | | | |
|---|---|---|---|
| 6,120,961 | A | 9/2000 | Tanikawa et al. |
| 6,156,471 | A | 12/2000 | Kobori et al. |
| 6,203,959 | B1 | 3/2001 | Tanikawa et al. |
| 6,235,441 | B1 | 5/2001 | Tanikawa et al. |
| 6,326,114 | B1 | 12/2001 | Itakura et al. |
| 6,528,222 | B2 | 3/2003 | Kohtaki et al. |
| 6,586,147 | B2 | 7/2003 | Iida et al. |
| 6,653,036 | B1 | 11/2003 | Tanikawa et al. |
| 6,664,016 | B2 | 12/2003 | Kanbayashi et al. |
| 6,670,087 | B2 | 12/2003 | Fujikawa et al. |
| 6,751,424 | B2 | 6/2004 | Komatsu et al. |
| 6,808,852 | B2 | 10/2004 | Hotta et al. |
| 6,905,808 | B2 | 6/2005 | Itakura et al. |
| 6,929,894 | B2 | 8/2005 | Sugahara et al. |
| 7,022,449 | B2 | 4/2006 | Sugahara et al. |
| 7,112,395 | B2 | 9/2006 | Ida et al. |
| 7,115,349 | B2 | 10/2006 | Iida et al. |
| 7,138,213 | B2 | 11/2006 | Itakura et al. |
| 7,144,668 | B2 | 12/2006 | Baba et al. |
| 7,147,980 | B2 | 12/2006 | Itakura et al. |
| 7,147,981 | B2 | 12/2006 | Fujikawa et al. |
| 7,229,727 | B2 | 6/2007 | Itakura et al. |
| 7,232,636 | B2 | 6/2007 | Semura et al. |
| 7,279,262 | B2 | 10/2007 | Fujikawa et al. |
| 7,288,348 | B2 | 10/2007 | Hayami et al. |
| 7,297,455 | B2 | 11/2007 | Fujikawa et al. |
| 7,300,733 | B2 | 11/2007 | Sugahara et al. |
| 7,320,850 | B2 | 1/2008 | Itakura et al. |
| 7,361,441 | B2 | 4/2008 | Itakura et al. |
| 7,396,626 | B2 | 7/2008 | Fujikawa et al. |
| 7,396,629 | B2 | 7/2008 | Baba et al. |
| 7,442,478 | B2 | 10/2008 | Itakura et al. |
| 7,452,647 | B2 | 11/2008 | Hayami et al. |
| 7,611,813 | B2 | 11/2009 | Ida et al. |
| 7,629,100 | B2 | 12/2009 | Okamoto et al. |
| 7,767,370 | B2 | 8/2010 | Ishigami et al. |
| 7,824,831 | B2 | 11/2010 | Yamada et al. |
| 7,858,283 | B2 | 12/2010 | Ishigami et al. |
| 7,906,262 | B2 | 3/2011 | Ishigami et al. |
| 7,927,775 | B2 | 4/2011 | Komatsu et al. |
| 7,939,233 | B2 | 5/2011 | Inoue et al. |
| 8,084,174 | B2 | 12/2011 | Hasegawa et al. |
| 8,114,562 | B2 | 2/2012 | Ishigami et al. |
| 8,137,886 | B2 | 3/2012 | Baba et al. |
| 8,142,972 | B2 | 3/2012 | Hotta et al. |
| 8,182,971 | B2 | 5/2012 | Koike et al. |
| 8,288,069 | B2 | 10/2012 | Fujikawa et al. |
| 8,298,742 | B2 | 10/2012 | Okamoto et al. |
| 8,323,726 | B2 | 12/2012 | Naka et al. |
| 2010/0028796 | A1 | 2/2010 | Nakamura et al. |
| 2010/0183971 | A1 | 7/2010 | Fujikawa et al. |
| 2010/0248126 | A1 | 9/2010 | Ishigami et al. |
| 2010/0273103 | A1 | 10/2010 | Baba et al. |
| 2010/0310978 | A1 | 12/2010 | Endo et al. |
| 2011/0097661 | A1 | 4/2011 | Ishigami et al. |
| 2012/0094225 | A1 | 4/2012 | Ishigami et al. |
| 2012/0214097 | A1 | 8/2012 | Naka et al. |
| 2013/0196265 | A1 | 8/2013 | Kamae et al. |
| 2013/0244159 | A1 | 9/2013 | Ishigami et al. |
| 2013/0244164 | A1 | 9/2013 | Fujikawa et al. |

FOREIGN PATENT DOCUMENTS

| | | | |
|---|---|---|---|
| JP | 2000-39738 | A | 2/2000 |
| JP | 2002-287427 | A | 10/2002 |
| JP | 2004-109485 | A | 4/2004 |
| JP | 2007-4149 | A | 1/2007 |
| JP | 2007-79086 | A | 3/2007 |
| JP | 2009-58849 | A | 3/2009 |
| JP | 2009-92822 | A | 4/2009 |
| JP | 2010-96987 | A | 4/2010 |

OTHER PUBLICATIONS

Shiotari, et al., U.S. Appl. No. 13/995,499, 371(c) date Jun. 18, 2013.
Komatsu, et al., U.S. Appl. No. 13/902,365, filed May 24, 2013.
Ishigami, et al., U.S. Appl. No. 13/901,250, filed May 23, 2013.
Hashimoto, et al., U.S. Appl. No. 13/867,398, filed Apr. 22, 2013.
Chinese Office Action dated Jul. 30, 2014 in Chinese Application No. 201180044885.X.

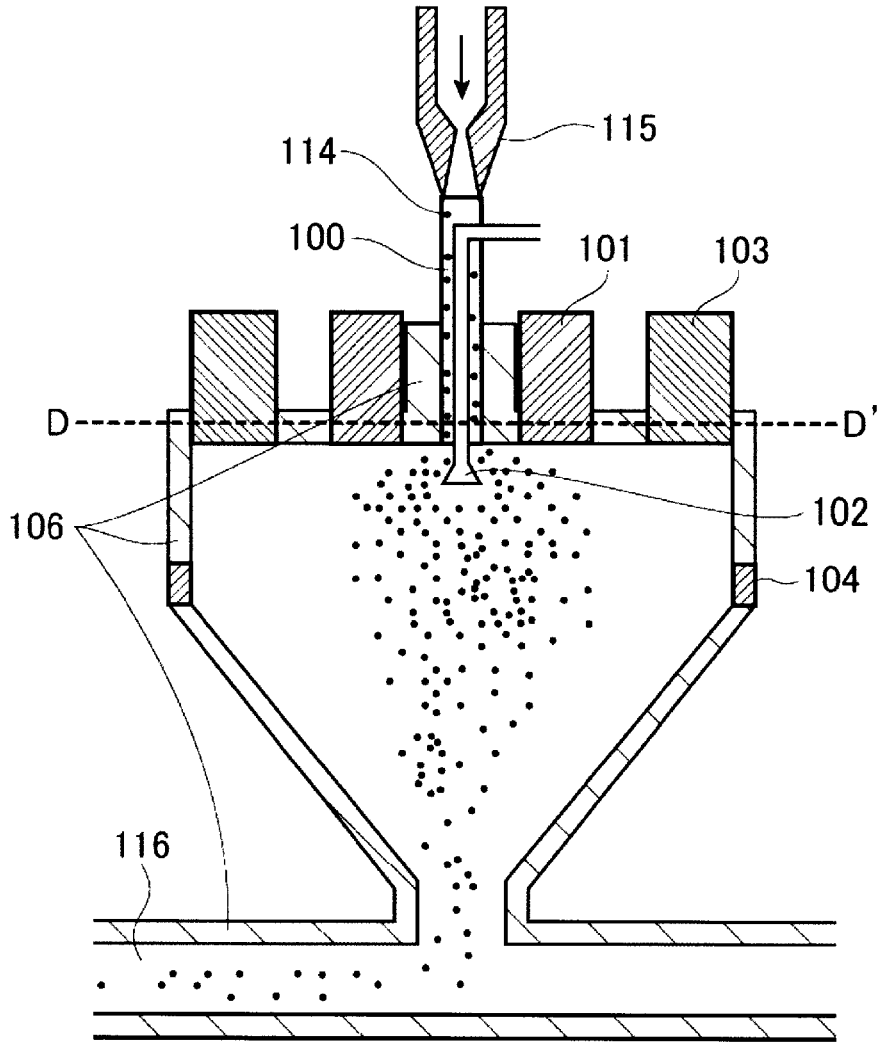
115
114
100
101
103
D
D'
106
102
104
116

TONER

TECHNICAL FIELD

The present invention relates to a toner for use in electrophotographic systems, electrostatic recording systems, electrostatic printing systems, and toner jet systems.

BACKGROUND ART

There has been ever greater demand for energy-conserving measures in recent years as electrophotographic full-color copiers have become more widespread. In pursuit of energy-conserving measures, investigations have been carried out into technology that can cause toner to undergo fixing at lower fixation temperatures in order to lower power consumption in the fixing process. The use in toner of a resin having a sharp-melt property is preferred for improving the low-temperature fixability of toner, and in recent years, polyester resins have been used as sharp-melting resins.

For example, Patent Document 1 provides a toner composed of a high softening point polyester resin and a low softening point polyester resin in 80 to 30:20 to 70 (weight ratio). Patent Document 2 provides a toner that is prepared by using a crosslinked aliphatic alcohol-based polyester resin and a non-crosslinked aromatic alcohol-based polyester resin. Patent Document 3 provides a toner that contains a high softening point polyester with a softening point of 120 to 160° C. and a low softening point polyester with a softening point of 75 to 120° C. Patent Document 4 provides a toner that contains a polyester resin having acid value of 13 to 50 mg KOH/g and hydroxyl value of not more than 8 mg KOH/g.

These toners exhibit some effects with regard to improvement of the low-temperature fixability, but when used in high-speed machines, they provide an increased adhesive force between the fixing member and the recording paper, which can result in the recording paper wrapping onto the fixing member.

In addition, these toners exhibit reduced toner chargeability and are prone to undergo charge relaxation. In particular, when these toners are used at high print coverage rates in a high temperature/high humidity environment, toner charging level is decreased, which can ultimately produce large variations in image density and fogging in white background regions.

[Patent Document 1] Japanese Patent Application Laid-open No. H11-305486

[Patent Document 2] Japanese Patent Application Laid-open No. 2000-39738

[Patent Document 3] Japanese Patent Application Laid-open No. 2002-287427

[Patent Document 4] Japanese Patent Application Laid-open No. 2007-4149

DISCLOSURE OF THE INVENTION

An object of the present invention is to provide a toner that solves the problems identified above. Specifically, an object of the present invention is to provide a toner that exhibits a balance between low-temperature fixability and hot offset resistance and that exhibits an excellent resistance to wrap-around during fixing. A further object of the present invention is to provide a toner that can suppress image density variations and fogging in white background regions at high print coverage rate at high temperature and high humidity.

The present invention relates to toner comprising toner particles, each of which contains a binder resin and a wax, and inorganic fine particles, the toner being characterized in that the binder resin contains a polyester resin A obtained by condensation polymerization of a polyvalent carboxylic acid and an alcohol component mainly containing an aromatic diol, and a polyester resin B obtained by condensation polymerization of a polyvalent carboxylic acid and an alcohol component mainly containing an aliphatic diol, and in that, in the FT-IR spectrum obtained by attenuated total reflectance (ATR) method by using Ge as the ATR crystal and under the condition of an infrared light-incidence angle of 45°, Pa is the intensity of the highest absorption peak in the range from 2843 $cm^{-1}$ to 2853 $cm^{-1}$ and Pb is the intensity of the highest absorption peak in the range from 1713 $cm^{-1}$ to 1723 $cm^{-1}$, while in the FT-IR spectrum measured by ATR using KRS5 as the ATR crystal and under the condition of an infrared light-incidence angle of 45°, Pc is the intensity of the highest absorption peak in the range from 2843 $cm^{-1}$ to 2853 $cm^{-1}$ and Pd is the intensity of the highest absorption peak in the range from 1713 $cm^{-1}$ to 1723 $cm^{-1}$, while in the FT-IR spectrum obtained by attenuated total reflectance (ATR) method by using KRS5 as the ATR crystal and under the condition of an infrared light-incidence angle of 45°, the toner satisfies the relationship in the following equation (1).

$$1.05 \leq P1/P2 \leq 2.00 \quad \text{formula (1)}$$

(where P1=Pa/Pb and P2=Pc/Pd in the above formula (1))

The present invention can provide a toner that exhibits balance between the low-temperature fixability and hot offset resistance and that exhibits an excellent resistance to wrap-around during fixing. The present invention also provides a toner that can suppress image density variations and fogging in white background regions at high print coverage rate at high temperature and high humidity.

BRIEF DESCRIPTION OF THE DRAWINGS

FIG. 1 is a schematic cross-sectional diagram of a surface treatment apparatus.

MODE FOR CARRYING OUT THE INVENTION

The toner of the present invention contains a polyester resin A obtained by condensation polymerization of a polyvalent carboxylic acid and an alcohol component mainly containing an aromatic diol, and a polyester resin B obtained by condensation polymerization of a polyvalent carboxylic acid and an alcohol component mainly containing is an aliphatic diol, as binder resin.

In order to further improve the low-temperature fixability, the inventors have been pursuing improvements to polyester resins that have an excellent sharp melt property. On the other hand, the inventors thought that it was crucial for the polyester resin-containing binder resin to be adequately charged by friction against the charge-providing member and the like, and to be provided with the ability to resist charge relaxation. As a result, the inventors discovered that, by having the binder resin contain a polyester resin A obtained by condensation polymerization of a polyvalent carboxylic acid and an alcohol component mainly containing an aromatic diol, and a polyester resin B obtained by condensation polymerization of a polyvalent carboxylic acid and an alcohol component mainly containing an aliphatic diol, the toner could be adequately charged by friction against the charge-providing member and the like, and provided with the ability to resist charge relaxation. Tue inventors also discovered that, by providing these properties, image density variations and fogging in white background regions can be suppressed during use at high print coverage rates at high temperature and high humidity.

With regard to the above-mentioned mechanism, the inventors hypothesize as follows.

The molecular chain of polyester resin A is rich in aromatic rings originating from the aromatic diol, and polyester resin A thus has a large population of the π-electrons that are present in the aromatic rings, which facilitates electron transfer between molecular chains in the binder resin. As a result, chargeability of the polyester resin A when frictioned against the charge-providing member and the like is improved, and further, charge relaxation of the toner is also facilitated.

The facilitation of charge relaxation in the toner is particularly significant when carbon black is used as a colorant. Carbon black has a structure in which the carbon atoms are bonded in a network of six-membered rings; some of these structures form a multilayer structure, and a large π-electron system is thereby formed in interlayer. As a result, it is hypothesized that interaction between the aromatic rings in polyester resin A and the aromatic rings in carbon black results in an arrangement of the polyester resin A and carbon black in which they undergo stacking with each other, and thereby a very extended π-electron system is yield. Due to this, electron transfer between the molecular chains in the binder resin is facilitated and charge relaxation of the toner is facilitated even further.

On the other hand, the molecular chain of polyester resin B has few aromatic rings as compared with polyester resin A, and therefore electron transfer in the binder resin because is suppressed. As a consequence, chargeability of the polyester resin B when frictioned against the charge-providing member and the like is then not very good, or charge relaxation of the toner neither suppressed.

Accordingly, in the present invention, in order to ameliorate the ability of polyester resin A to facilitate charge relaxation of the toner, an excellent chargeability when frictioned against the charge-providing member and the like was consisted with a property of suppressing charge relaxation of the toner by having polyester resin A contain polyester resin B.

The content ratio between polyester resin A and polyester resin B (A/B) in the binder resin is preferably from at least 50/50 to not more than 95/5, more preferably from at least 55/45 to not more than 90/10, and even more preferably from at least 65/35 to not more than 80/20 on a mass basis.

The content ratio between the polyester resin A and polyester resin B (A/B) preferably falls in the above-described range because the ability to suppress charge relaxation is obtained in this range while toner chargeability is maintained.

When the content ratio between polyester resin A and polyester resin B (A/B) in the binder resin is less than 50/50 on a mass basis, the amount of polyester resin B relatively large, and therefore the chargeability of the toner tends to decrease.

On the other hand, when the content ratio between polyester resin A and polyester resin B (A/B) exceeds 95/5 on a mass basis, the effect of addition of polyester resin B is not adequately provided, and therefore facilitation of charge relaxation of the toner prone to occur. As a consequence, image density variations and fogging in white background regions likely to occur during use at high print coverage rates at high temperature and high humidity.

The toner of the present invention characteristically satisfies the relationship in the following formula (1).

$$1.05 \leq P1/P2 \leq 2.00 \quad \text{formula (1)}$$

P1 is an index related to the abundance ratio for the wax with reference to the binder resin at approximately 0.3 μm from the toner surface in the toner depth direction from the toner surface to the center of the toner, while P2 is an index related to the abundance ratio for the wax with reference to the binder resin at approximately 1.0 μm from the toner surface.

A characteristic feature of the present invention is that the ratio between these abundance ratio indices [P1/P2] (that is, the degree of segregation of the wax in the toner depth direction from the toner surface to the center of the toner) is controlled by setting the index (P1) related to the abundance ratio for the wax with reference to the binder resin at approximately 0.3 μm from the toner surface larger than the index (P2) related to the abundance ratio for the wax with reference to the binder resin at approximately 1.0 μm from the toner surface.

It is thought that by controlling [P1/P2] into the above-described range, the wax present in large amounts in the vicinity of the toner surface can further promote exudation of the wax present in the vicinity of center region. The reason for this is as follows: pathways for the wax from the toner inside to the toner surface are formed by the melting of the wax present in the vicinity of the toner surface, and the wax is thereby effectively exuded during fixing. The exuded wax can further raise the release performance, and thereby can improve resistance to wraparound during fixing.

When [P1/P2] is less than 1.05, wax exudation rate during fixing is slow, and, in the case of a device performing high-speed image formation, such as POD, image glossiness decreases and/or the resistance to wraparound during fixing decreases. Furthermore, when [P1/P2] exceeds 2.00, while the resistance to wraparound during fixing is improved, excess wax is also present in the vicinity of the toner surface, and as a result the toner flowability is substantially reduced and triboelectric charge quantity of the toner and the charge-providing member changes largely, which ultimately result in the generation of density variations and fogging of white backgrounds.

The [P1/P2] of the toner is preferably from at least 1.15 to not more than 1.90 and more preferably is from at least 1.25 to not more than 1.85.

The [P1/P2] of conventional pulverized toners and polymerized toners is less than 1.00, and large amounts of wax must be added to improve the separation during fixing. As a result, the triboelectric charge quantity changes largely due to the embedding or elimination of external additives, and density variations and fogging of white backgrounds can then occur.

In addition, it is possible with conventional heat-spheronized toner to cause the value of P1/P2 to vary in correspondence to the degree of spheronizing. However, with heat-spheronized toner, the wax is immediately brought out to the toner surface by a small amount of heat and the value of P1/P2 ends up exceeding 2.00 prior to spheronization of the toner.

The [P1/P2] of a toner can also be controlled into the range specified above by independently controlling P1 and P2. Means for independently controlling P1 and P2 are described below.

The method of calculating the [P1/P2] of the toner is as follows.

Pa is defined as the intensity of the highest absorption peak in the range from 2843 $cm^{-1}$ to 2853 $cm^{-1}$ and Pb is defined as the intensity of the highest absorption peak in the range from 1713 $cm^{-1}$ to 1723 $cm^{-1}$ in the FT-IR spectrum obtained by measurement by ATR using Ge for the ATR crystal and 45° for the infrared angle of incidence, and Pc is defined as the intensity of the highest absorption peak in the range from 2843 $cm^{-1}$ to 2853 $cm^{-1}$ and Pd is defined as the intensity of the highest absorption peak in the range from 1713 $cm^{-1}$ to 1723 $cm^{-1}$ in the FT-IR spectrum measured by ATR using KRS5 as the ATR crystal and 45° for the infrared angle of incidence. P1 and P2 are then calculated as follows: P1=Pa/Pb and P2=Pc/Pd.

Here, the intensity of the highest absorption peak Pa is the value obtained by subtracting the average value of the absorption intensity at 3050 $cm^{-1}$ and 2600 $cm^{-1}$ from the maximum value of the absorption peak intensity in the range from 2843 $cm^{-1}$ to 2853 $cm^{-1}$.

The intensity of the highest absorption peak Pb is the value obtained by subtracting the average value of the absorption intensity at 1763 $cm^{-1}$ and 1630 $cm^{-1}$ from the maximum value of the absorption peak intensity in the range from 1713 $cm^{-1}$ to 1723 $cm^{-1}$.

The intensity of the highest absorption peak Pc is the value obtained by subtracting the average value of the absorption intensity at 3050 $cm^{-1}$ and 2600 $cm^{-1}$ from the maximum value of the absorption peak intensity in the range from 2843 $cm^{-1}$ to 2853 $cm^{-1}$.

The intensity of the highest absorption peak Pd is the value obtained by subtracting the average value of the absorption intensity at 1763 $cm^{-1}$ and 1630 $cm^{-1}$ from the maximum value of the absorption peak intensity in the range from 1713 $cm^{-1}$ to 1723 $cm^{-1}$.

The absorption peak in the range from 1713 $cm^{-1}$ to 1723 $cm^{-1}$ in the FT-IR spectrum is a peak attributed to the stretching vibration of —CO— mainly originating from the binder resin.

Various other peaks other than those above, such as the out-of-plane bending vibration of the aromatic ring CH, can also be detected as peaks that originate from the binder resin. However, a large number of peaks are present in the range below 1500 $cm^{-1}$, therefore it is difficult to separate just the binder resin peaks, and it cannot be possible to calculate accurate numerical values. Therefore, the absorption peak in the range from 1713 $cm^{-1}$ to 1723 $cm^{-1}$, which can easily be separated from other peaks, is used as the peak originating from the binder resin.

The absorption peak in the range from 2843 $cm^{-1}$ to 2853 $cm^{-1}$ in the FT-IR spectrum is a peak attributed to the stretching vibration (symmetric) of —$CH_2$— mainly originating from the wax.

In addition to those above, a peak for the in-plane bending vibration of $CH_2$ can be detected as a wax peak at from 1450 $cm^{-1}$ to 1500 $cm^{-1}$; however, this also overlaps with a binder resin peak, and therefore it is difficult to separate the wax peak from the others. Therefore, the absorption peak in the range from 2843 $cm^{-1}$ to 2853 $cm^{-1}$, which can easily be separated from other peaks, is used as the peak originating from the wax.

In order to eliminate the influence of the baseline and thereby calculate true peak intensity, the average value of the absorption intensity at 3050 $cm^{-1}$ and 2600 $cm^{-1}$ is subtracted from the maximum value of the absorption peak intensity in the range from 2843 $cm^{-1}$ to 2853 $cm^{-1}$ in the determination of Pa and Pc. Since ordinarily no absorption peaks occur in the neighborhood of 3050 $cm^{-1}$ and 2600 $cm^{-1}$, the baseline intensity can be calculated by calculating the average value at these two points. The same reasoning applies to subtracting the average value of the absorption intensity at 1763 $cm^{-1}$ and 1630 $cm^{-1}$ from the maximum value of the absorption peak intensity in the range from 1713 $cm^{-1}$ to 1723 $cm^{-1}$ in the determination of Pb and Pd.

The intensity of the highest absorption peak originating from the binder resin (Pb, Pd) and the intensity of the highest absorption peak originating from the wax (Pa, Pc) are related to the amount of binder resin present and the amount of wax present, respectively. In the present invention, therefore, the abundance ratio for the wax relative to the binder resin is calculated by dividing the intensity of the highest absorption peak originating from the wax by the intensity of the highest absorption peak originating from the binder resin.

In order for releasability from the fixing member to occur, it is essential to form a release layer between the fixing member and toner layer by exuding the wax during the fixing step.

However, in the case of a high-speed machine such as POD, toner melting time in the fixing step is short, and therefore wax exudation time become short and a release layer cannot be sufficiently formed. This results in deterioration in the ability to resist wraparound during fixing. Large amounts of wax must then be added in order to accommodate machines that engage in high-speed image formation, such as POD. In this case, however, large variations are induced in the triboelectric charge quantity due to the embedding and elimination of external additives, resulting in the generation of density variations and fogging in white backgrounds.

As a result of intensive investigations by the present inventors, it was found that P1 correlates with image glossiness and the resistance to wraparound during fixing. This is thought to be based on the following reason. Adjustment of P1 into a suitable range causes the abundance ratio for the wax with respect to the binder resin to become suitably large at approximately 0.3 μm in the depth direction from the toner surface, and the melting of this wax then promotes exudation of the wax present at the center of the toner. As a result, even in machines that engage in high-speed image formation, such as POD, the wax rapidly melts and exudes in a satisfactory amount in the fixing step, as a consequence of which a release effect is generated and an excellent separation property between the fixing member and the toner layer then is provided.

In particular, P1 is preferably from at least 0.10 to not more than 0.70 and is more preferably from at least 0.12 to not more than 0.66.

In the meantime, in the present invention, it was found that the distribution state of the wax is crucial for the generation of a release effect in the fixing step. Specifically, the wax abundance ratio at approximately 0.3 μm was adopted as P1 in the present invention because the wax exudation behavior was correlated with the wax abundance ratio at approximately 0.3 μm.

P1 can be controlled into the specified range by changing the treatment conditions during surface treatment with a hot air current and by controlling the type and amount of addition of the wax present in the toner particle before the heat treatment. For example, to raise P1, procedures can be exemplified such as raising the temperature in the surface treatment with a hot air current and increasing the amount of wax addition. On the other hand, to lower P1, procedures can be exemplified such as lowering the temperature in the surface treatment with a hot air current and decreasing the amount of wax addition. However, when P1 is changed using these procedures, the rate of change in P1 is overly rapid, and control is thus quite difficult. Therefore, controlling the state of dispersion of the wax is preferred in addition to the above-described procedures. The rate of change in P1 can be controlled by doing this. For example, the dispersion property of the wax can also be controlled by having the wax contain hydrophobic silica particles as an internal additive.

Controlling P1 into the specified range is crucial for improving image glossiness and improving the resistance to wraparound during fixing. The wax, however, is soft since it has a smaller molecular weight than that of the binder resin. Due to this, even when P1 was brought into the specified range, large variations in the triboelectric charge quantity could occur due to the durability, and density variations and fogging in white backgrounds were thus ultimately generated.

Therefore, the stability of the triboelectric charge quantity of the toner and the charge-providing member is preferably improved by controlling the abundance ratio for the wax with reference to the binder resin (P2) at approximately 1.0 μm in the depth direction from the toner surface.

In the meantime, in the present invention, in order to stabilize for the triboelectric charge quantity of the toner and the charge-providing member, it was found to be crucial to prevent the external additive used for the toner from becoming embedded. Specifically, in the present invention, the wax abundance ratio at approximately 1.0 μm was adopted as P2 because the inhibition of external additive embedding was correlated with the wax abundance ratio at approximately 1.0 μm.

The mechanism is unclear, but the present inventors hypothesize the following.

In order to suppress timewise variations in the triboelectric charge quantity of the toner and the charge-providing member, it is crucial to suppress changes in the toner surface that arise due to durability testing. Specifically, it is important to suppress the elimination and embedding of external additives that can occur due to stress within the developing device.

With regard to the embedding of external additives, not only the hardness of the toner surface but also the hardness of the layer below the toner surface are thought to be involved. For example, it is thought that even if a large amount of wax is present in the outermost layer of the toner, an external additive will not be embedded to a degree that will cause a loss of its function if the layer below the outermost layer is composed of a hard resin layer. Therefore, the abundance ratio of the wax with reference to the binder resin (P2) at approximately 1.0 μm in the depth direction from the toner surface is crucial. It is thought that controlling P2 into the specified range can provide a suppression of external additive embedding and thus a suppression of variations in the triboelectric charge quantity. In particular, P2 is preferably from at least 0.05 to not more than 0.35 and is more preferably from at least 0.06 to not more than 0.33.

P2 can be controlled into the specified range by changing the type and amount of wax addition, changing the dispersion diameter of the wax in the toner, and changing the treatment conditions in the surface treatment using a hot air current. With regard to the dispersion diameter of the wax in the toner, for example, the dispersion diameter of the wax in the toner can also be changed by using hydrophobic silica particles as an internal additive.

Polyester resin A preferably has a softening point, measured using a constant load extrusion-type capillary rheometer, of from at least 70° C. to not more than 95° C. and preferably has a hydroxyl value of from at least 30 mg KOH/g to not more than 90 mg KOH/g. The softening point is more preferably from at least 75° C. to not more than 95° C. and is particularly preferably from at least 80° C. to not more than 95° C. The hydroxyl value is more preferably from at least 40 mg KOH/g to not more than 85 mg KOH/g and is particularly preferably from at least 50 mg KOH/g to not more than 80 mg KOH/g.

In the present invention, polyester resin A preferably has a softening point in the above-described range from the perspective of improving the low-temperature fixability. On the other hand, the hydroxyl value of polyester resin A is preferably in the above-described range from the standpoint of increasing the chargeability.

Polyester resin B preferably has a softening point, measured using a constant load extrusion-type capillary rheometer, of from at least 100° C. to not more than 150° C. and preferably has a hydroxyl value of not more than 20 mg KOH/g. The softening point is more preferably from at least 110° C. to not more than 145° C. and is particularly preferably from at least 120° C. to not more than 140° C. The hydroxyl value is more preferably not more than 15 mg KOH/g and is particularly preferably not more than 10 mg KOH/g.

Polyester resin B preferably has a softening point in the above-described range from the perspective of improving the hot offset resistance. On the other hand, the hydroxyl value of polyester resin B is preferably in the above-described range from the standpoint of suppressing charge relaxation.

The softening points of the polyester resins can be adjusted into the above-described ranges by controlling the reaction conditions and controlling the molecular weight. In addition, the hydroxyl values of the polyester resins can be adjusted into the above-described ranges by controlling the monomer ratios in the starting material.

In the present invention, the average circularity of the toner in the invention, which is measured using a flow-type particle image analyzer with an image processing resolution of 512×512 pixels (0.37 μm×0.37 μm per pixel) and analyzed by fractionating 800 particles with a circle-equivalent diameter of at least 1.98 μm to less than 39.69 μm in the circularity range of from at least 0.200 to not more than 1.000, is preferably from at least 0.950 to not more than 1.000. The transfer property is improved when the average circularity of the toner is in the above-described range. The average circularity of the toner is more preferably from at least 0.960 to not more than 0.980. In addition, the number % of particles from at least 0.50 μm to less than 1.98 μm (fine particle toner) in the toner with reference to the total particles having a circle-equivalent diameter of from at least 0.50 μm to less than 39.69 μm, which is measured using a flow-type particle image analyzer with an image processing resolution of 512×512 pixels (0.37 μm×0.37 μm per pixel), is preferably not more than 15.0 number % in the invention. It is more preferably not more than 10.0 number % and particularly preferably is not more than 5 number %.

When the proportion of fine particle toner is not more than 15 number %, it is possible to decrease adhesion of the fine particle toner to the charge-providing member. As a result, charge stability of the toner can be maintained long term. This average circularity and proportion of fine particle toner can be controlled using the method of producing the toner and the method of classifying the toner.

The binder resin used in the toner of the present invention contains a polyester resin A obtained by condensation polymerization of a polyvalent carboxylic acid and an alcohol component mainly containing an aromatic diol and a polyester resin B obtained by condensation polymerization of a polyvalent carboxylic acid and an alcohol component mainly containing an aliphatic diol.

There are no particular limitations on the aromatic diol used for polyester resin A, and this aromatic diol can be exemplified by alkylene oxide adducts on bisphenol A such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)polyoxyethylene(2.0)-2,2-bis(4-hydroxyphenyl)propane, polyoxypropylene(6)-2,2-bis(4-hydroxyphenyl)propane.

Alcohol component that can be used in the polyester resin A can be exemplified by ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

As noted above, the aromatic diol is the main component of the alcohol component constituting polyester resin A. The aromatic diol content in the alcohol component constituting polyester resin A is preferably from at least 80 mol % to 100 mol %, more preferably from at least 90 mol % to 100 mol %, and particularly preferably 100 mol %.

There are no particular limitations on the aliphatic diol used for polyester resin B, and the aliphatic diol can be exemplified by ethylene glycol, diethylene glycol, triethylene glycol, 1,2-propylene glycol, 1,3-propylene glycol, 1,4-butanediol, 2,3-butanediol, neopentyl glycol, 1,4-butenediol, 1,5-pentanediol, 2,3-pentanediol, 1,6-hexanediol, 2,3-hexanediol, 3,4-hexanediol, 1,4-cyclohexanedimethanol, polyethylene glycol, polypropylene glycol, polytetramethylene glycol, and neopentyl glycol.

Alcohol component that can be used in polyester resin B be exemplified by alkylene oxide adducts on bisphenol A such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, polyoxypropylene(6)-2,2-bis(4-hydroxyphenyl)propane.

As noted above, the aliphatic diol is the main component in the alcohol component constituting polyester resin B. The aliphatic diol content in the alcohol component constituting polyester resin B is preferably from at least 80 mol % to 100 mol %, more preferably from at least 90 mol % to 100 mol %, and particularly preferably 100 mol %.

There are no particular limitations on the polyvalent carboxylic acid that can be used for polyester resin A and polyester resin B, and this polyvalent carboxylic acid can be exemplified by the following: aromatic dicarboxylic acids such as phthalic acid, isophthalic acid and terephthalic acid, and their anhydrides; alkyl dicarboxylic acids such as succinic acid, adipic acid, sebacic acid and azelaic acid, and their anhydrides; succinic acid substituted by a $C_{6-18}$ alkyl or alkenyl group, and anhydrides thereof; and unsaturated dicarboxylic acids such as fumaric acid, maleic acid and citraconic acid, and anhydrides thereof. Among these, polyvalent carboxylic acids such as terephthalic acid, succinic acid, adipic acid, fumaric acid, trimellitic acid, pyromellitic acid and benzophenonetetracarboxylic acid, and their anhydrides are preferably used. Among these, aromatic dicarboxylic acids in particular preferably constitute at least 80 mol % of the total acid component and more preferably constitute at least 90 mol % of the total acid component. The total content of polyester resin A and polyester resin B in the binder resin, expressed with respect to the total amount of the binder resin, is preferably from at least 60 mass % to 100 mass %, more preferably from at least 75 mass % to 100 mass %, and particularly preferably 100 mass %.

The acid value of polyester resin A is preferably from at least 1 mg KOH/g to not more than 20 mg KOH/g from the standpoint of avoiding any further worsening of charge relaxation. The acid value of polyester resin B is preferably from at least 10 mg KOH/g to not more than 50 mg KOH/g from the standpoint of providing an additional increase in the chargeability.

The acid values of the polyester resins can be brought into the above-described ranges by adjusting the type and content of the monomers used for the resin. In specific terms, it can be controlled by adjusting the alcohol monomer component ratio/acid component ratio, and molecular weight during resin production. Further, it can be controlled by reacting a polyvalent acid monomer (for example, trimellitic acid) with the terminal alcohol after the ester condensation polymerization.

In addition to the polyester resin A and polyester resin B described above, the following polymers can also be added as the binder resin used in the toner of the present invention, to the extent that they do not influence the effects of the invention: homopolymers of styrene and substituted styrene such as polystyrene, poly-p-chlorostyrene, polyvinyltoluene; styrenic copolymers such as styrene-p-chlorostyrene copolymer, styrene-vinyltoluene copolymer, styrene-vinylnaphthalene copolymer, styrene-acrylate ester copolymer, styrene-methacrylate ester copolymer, styrene-α-methyl chloromethacrylate copolymer, styrene-acrylonitrile copolymer, styrene-vinyl methyl ether copolymer, styrene-vinyl ethyl ether copolymer, styrene-vinyl methyl ketone copolymer, styrene-acrylonitrile-indene copolymer; polyvinyl chloride, phenolic resins, natural modified phenolic resins, natural resin-modified maleic acid resins, acrylic resins, methacrylic resins, polyvinyl acetate, silicone resins, polyester resins, polyurethanes, polyamide resins, furan resins, epoxy resins, xylene resins, polyvinyl butyrals, terpene resins, coumarone-indene resins, and petroleum resins.

There are no particular limitations on the wax used in the toner of the present invention, and this wax can be exemplified by the following: hydrocarbon waxes such as low molecular weight polyethylene, low molecular weight polypropylene, alkylene copolymers, microcrystalline wax, paraffin wax and Fischer-Tropsch waxes; oxides of hydrocarbon waxes such as oxidized polyethylene wax, and their block copolymers; waxes mainly containing a fatty acid ester such as carnauba wax; and waxes provided by the partial or complete deacidification of fatty acid esters such as deacidified carnauba wax.

Additional examples are as follows: saturated straight-chain fatty acids such as palmitic acid, stearic acid and montanic acid; unsaturated fatty acids such as brassidic acid, eleostearic acid and parinaric acid; saturated alcohols such as stearyl alcohol, aralkyl alcohols, behenyl alcohol, carnaubyl alcohol, ceryl alcohol and melissyl alcohol; polyhydric alcohols such as sorbitol; esters between a fatty acid such as palmitic acid, stearic acid, behenic acid or montanic acid, and an alcohol such as stearyl alcohol, aralkyl alcohol, behenyl alcohol, carnaubyl alcohol, ceryl alcohol or melissyl alcohol; fatty acid amides such as linoleamide, oleamide and lauramide; saturated fatty acid bisamides such as methylenebisstearamide, ethylenebiscapramide, ethylenebislauramide and hexamethylenebisstearamide; unsaturated fatty acid amides such as ethylenebisoleamide, hexamethylenebisoleamide, N,N'-dioleyladipamide and N,N'-dioleylsebacamide; aromatic bisamides such as m-xylenebisstearamide and N,N'-distearylisophthalamide; aliphatic metal salts (generally known as metal soaps) such as calcium stearate, calcium laurate, zinc stearate and magnesium stearate; waxes provided by grafting an aliphatic hydrocarbon wax by using a vinyl monomer such as styrene or acrylic acid; partial esters between a polyhydric alcohol and a fatty acid such as behenic monoglyceride; and hydroxyl group-containing methyl ester compounds obtained by the hydrogenation of plant oils.

Among these, hydrocarbon waxes such as paraffin waxes and Fischer-Tropsch waxes are preferred from the perspective of improving the low-temperature fixability and improving the resistance to wraparound during fixing.

The wax content in the present invention, expressed per 100 mass parts of the binder resin, is preferably from at least 0.5 mass part to not more than 20 mass parts, more preferably from at least 2 mass parts to not more than 15 mass parts, and particularly preferably from at least 3 mass parts to not more than 10 mass parts. From the perspective of balancing toner storability with its hot offset property, the wax preferably has a peak temperature for the highest endothermic peak, as measured using a differential scanning calorimeter, of from at least 45° C. to not more than 140° C.

There are no particular limitations on the colorant that can be used in the toner of the present invention, and the colorant can be exemplified as follows.

Black colorants can be exemplified by carbon black and colorants providing by color mixing using a yellow colorant, magenta colorant and cyan colorant to yield black. Pigment may be used alone for the colorant, but the improved sharpness provided by the co-use of a dye with a pigment is more preferred from the standpoint of the image quality of the full-color image.

Colored pigments for magenta toners can be exemplified by the following: C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238 and 269; C. I. Pigment Violet 19; and C. I. Vat Red 1, 2, 10, 13, 15, 23, 29 and 35.

Dyes for magenta toners can be exemplified by oil-soluble dyes such as C. I. Solvent Red 1, 3, 8, 23, 24, 25, 27, 30, 49, 81, 82, 83, 84, 100, 109 and 121; C. I. Disperse Red 9; C. I. Solvent Violet 8, 13, 14, 21 and 27; and C. I. Disperse Violet 1; and basic dyes such as C. I. Basic Red 1, 2, 9, 12, 13, 14, 15, 17, 18, 22, 23, 24, 27, 29, 32, 34, 35, 36, 37, 38, 39 and 40; and C. I. Basic Violet 1, 3, 7, 10, 14, 15, 21, 25, 26, 27 and 28.

Colored pigments for cyan toners can be exemplified by the following: C. I. Pigment Blue 2, 3, 15:2, 15:3, 15:4, 16 and 17; C. I. Vat Blue 6; C. I. Acid Blue 45; and copper phthalocyanine pigments in which the phthalocyanine skeleton is substituted by 1 to 5 phthalimidomethyl groups.

Colored dyes for cyan can be exemplified by C. I. Solvent Blue 70.

Colored pigments for yellow can be exemplified by the following: C. I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181 and 185; and C. I. Vat Yellow 1, 3 and 20.

Colored dyes for yellow can be exemplified by C. I. Solvent Yellow 162.

The amount of use of the colorant is preferably from at least 0.1 mass part to not more than 30 mass parts per 100 mass parts of the binder resin.

The toner of the present invention may as necessary also contain a charge control agent. While known charge control agents may be used for the charge control agent present in the toner, the charge control agent is particularly preferably a metal compound of an aromatic carboxylic acid that is colorless, that supports a high toner charging speed, and that can stably maintain a constant amount of charge. Typical examples are as follows. Negative charge control agents can be exemplified by metal compounds of salicylic acid, metal compounds of naphthoic acid, metal compounds of dicarboxylic acids, polymeric compounds that have a sulfonic acid or carboxylic acid in side chain position, polymeric compounds that have a sulfonate salt or sulfonate ester in side chain position, polymeric compounds that have a carboxylate salt or carboxylate ester in side chain position, boron compounds, urea compounds, silicon compounds, and calixarene. Positive charge control agents can be exemplified by quaternary ammonium salts, polymeric compounds that have the aforementioned quaternary ammonium salt in side chain position, guanidine compounds and imidazole compounds. The charge control agent may be an internal additive or an external additive for the toner particles. The amount of addition for the charge control agent is preferably from at least 0.2 mass part to not more than 10 mass parts per 100 mass parts of the binder resin.

In the toner of the present invention, inorganic fine particles are preferably added as an external additive in order to improve the flowability and to stabilize the durability. Silica, titanium oxide and aluminum oxide are preferred for the inorganic fine particles. The inorganic fine particles are preferably subjected to a hydrophobic treatment using a hydrophobing agent such as a silane compound, a silicone oil and a mixture them. In order to improve the flowability, the inorganic fine particles used as an external additive preferably have a BET specific surface area of from at least 50 $m^2/g$ to not more than 400 $m^2/g$. On the other hand, inorganic fine particles with a BET specific surface area of from at least 10 $m^2/g$ to not more than 50 $m^2/g$ are preferred for durability stabilization. Some types of inorganic fine particles having BET specific surface areas in the above-described ranges can be preferably used in combination in order to obtain both an improved flowability and durability stabilization.

As an external additive, the inorganic fine particles are preferably used at from at least 0.1 mass part to not more than 5.0 mass parts per 100 mass parts of the toner particles. The toner particles can be mixed with the external additive using a known mixer such as a Henschel mixer.

On the other hand, inorganic fine particles are preferably added to the toner particles as an internal additive from the perspective of controlling P1/P2. Silica, titanium oxide and aluminum oxide are examples of inorganic fine particles preferably used as the internal additive. These inorganic fine particles are preferably subjected to a hydrophobic treatment using a hydrophobing agent such as a silane compound, a silicone oil and a mixture of them. As an internal additive, the inorganic fine particles preferably have a BET specific surface area of from at least 10 $m^2/g$ to not more than 400 $m^2/g$. As an internal additive, the amount of addition of the inorganic fine particles is preferably from 0.5 mass part to 5.0 mass parts per 100 mass parts of the toner particles. It is thought that the inorganic fine particles have the effect of improving wax dispersibility when the inorganic fine particles are used as an internal additive in the toner particles.

The reason for the improved wax dispersibility by using the inorganic fine particles as an internal additive is thought to be as follows. The binder resin is generally relatively hydrophilic, while the wax is highly hydrophobic. As a consequence, when the toner is produced by a pulverization procedure, the wax is unlikely to be mixed with the binder resin during melt mixing/kneading of the binder resin and wax. However, when inorganic fine particles are present during melt mixing/kneading, the inorganic fine particles, being solid, are dispersed in the binder resin under the effect of mechanical shear. In addition, when the inorganic fine particles have been subjected to a hydrophobic treatment, the highly hydrophobic inorganic fine particles then have a high affinity for the wax; because of this, the wax comes to be present on the periphery of the inorganic fine particles and as a result the wax becomes readily dispersible in the binder resin. In addition, when the toner is produced by a pulverization procedure, if inorganic fine particles are present during the melt mixing/kneading the binder resin and wax, the viscosity of the molten mixture is raised and it becomes easier to apply shear to the molten mixture. This makes it easier to disperse the wax in the binder resin.

The toner of the present invention can be used as a single-component developer, but is preferably used as a two-component developer mixed with a magnetic carrier in order to obtain additional improvements in the dot reproducibility and also from the standpoint of obtaining an image that is long-term stable.

The magnetic carrier can be exemplified by the following: surface-oxidized iron powder; unoxidized iron powder; the particles of a metal such as iron, lithium, calcium, magnesium, nickel, copper, zinc, cobalt, manganese, chromium or a rare-earth metal; alloy particles of them; oxide particles; ferrite; and magnetic body dispersed resin carriers containing a magnetic body and a binder resin (or a so-called resin carrier).

When the toner of the present invention is used as a two-component developer mixed with a magnetic carrier, the magnetic carrier mixing ratio is preferably from at least 2 mass % to not more than 15 mass % as the toner concentration in the developer. More preferably, it is from at least 4 mass % to not more than 13 mass %.

The method of producing the toner particles in the invention can be exemplified by the following methods: pulverization methods in which the resin binder and wax are melt mixed/kneaded and the mixture is cooled and then pulverized and classified; suspension granulation methods in which suspension granulation is performed by introducing a solution of the binder resin and wax dissolved or dispersed in a solvent into an aqueous medium and the toner particles are then obtained by removing the solvent; suspension polymerization methods in which a monomer composition prepared by uniformly dissolving or dispersing the wax and so forth in monomer is dispersed in a continuous layer (for example, an aqueous phase) that contains a dispersion stabilizer and the toner particles are then produced by carrying out a polymerization reaction; dispersion polymerization methods, in which the toner particles are directly produced using an aqueous organic solvent in which the monomer is soluble but the obtained polymer is insoluble; emulsion polymerization methods, in which the toner particles are produced by polymerization directly in the presence of a water-soluble polar polymerization initiator; and emulsion aggregation methods in which the toner particles are obtained proceeding through a step of forming an aggregate of finely divided particles by aggregating the wax and a finely divided polymer and an aging step of inducing melt adhesion among the finely divided particles in the aggregate of finely divided particles.

The toner production procedure by a pulverization method is described in the following.

In a raw material mixing step, as a material constituting the toner particles, for example, the binder resin and wax and other optional components such as colorant and charge control agent are metered out in prescribed amounts, blended, and mixed. The mixer can be exemplified by double-cone mixers, V-mixers, drum mixers, super mixers, Henschel mixers, Nauta mixers and the Mechano Hybrid (Nippon Coke & Engineering Co., Ltd.).

The resulting raw material mixture is then melt mixed/kneaded in order to disperse the wax and so forth in the binder resin. A batch kneader such as a pressure kneader or a Banbury mixer, or a continuous kneader can be used in the melt mixing/kneading step. A single-screw or twin-screw extruder is typically used because they offer the advantage of enabling continuous production. Examples are the KTK twin-screw extruder (Kobe Steel, Ltd.), TEM twin-screw extruder (Toshiba Machine Co., Ltd.), PCM mixer/kneader (Ikegai Corp.), Twin Screw Extruder (KCK), Co-Kneader (Buss), and Kneadex (Nippon Coke & Engineering Co., Ltd.).

The resin composition obtained by melt mixing/kneading may be milled using a two-roll mill and cooled in a cooling step, for example, with water.

The cooled resin composition is then pulverized to the desired particle diameter in a pulverization step. In the pulverization step, a coarse pulverization is performed with a grinder such as a crusher, hammer mill or feather mill, followed by a fine pulverization with a pulverizer such as a Krypton System (Kawasaki Heavy Industries, Ltd.), Super Rotor (Nisshin Engineering Inc.) or Turbo Mill (Turbo Kogyo Co., Ltd.) or a fine pulverizer using an air jet system.

The toner particles are then obtained as necessary by carrying out classification using a sieving apparatus or classifier such as an internal classification system such as the Elbow Jet (Nittetsu Mining Co., Ltd.) or a centrifugal classification system such as the Turboplex (Hosokawa Micron Corporation), TSP Separator (Hosokawa Micron Corporation) or Faculty (Hosokawa Micron Corporation).

After pulverization, the toner particles may as necessary also be subjected to a surface treatment, such as a spheronizing treatment, using a Hybridization System (Nara Machinery Co., Ltd.), Mechanofusion System (Hosokawa Micron Corporation), Faculty (Hosokawa Micron Corporation) or Meteo Rainbow MR Type (Nippon Pneumatic Mfg. Co., Ltd.).

In the present invention, the toner particles are preferably obtained by carrying out a surface treatment with a hot air current using a surface treatment apparatus and thereafter performing classification. Alternatively, the already classified material may be subjected to the surface treatment with a hot air current using the surface treatment apparatus. For example, the apparatus shown in FIG. 1 can be used as the surface treatment apparatus. The toner particles used for the toner of the present invention are more preferably particles obtained by melting the toner surface by surface treatment with a hot air current and thereafter cooling with a cold air current. This surface treatment with hot air current proceeds by ejection of the toner by spraying from a compressed air feeding nozzle and exposing the ejected toner to a hot air current.

An outline of this hot air current-based surface treatment method will be described using FIG. 1. FIG. 1 is a cross-sectional diagram that shows an example of the surface treatment apparatus. The surface treatment is specifically performed on the toner as follows. After the above-described pulverizate (also referred to here as toner particles) has been obtained, it is fed to this surface treatment apparatus. The toner particles (114) fed from a toner particle feeding port (100) are accelerated by injection air sprayed from a compressed air feeding nozzle (115) and are directed into an underlying air current spray member (102). Dispersion air is sprayed from the air current spray member (102) and the toner particles are dispersed outwardly by this dispersion air. At this point, the state of dispersion of the toner can be controlled by adjusting the injection air flow rate and the dispersion air flow rate.

In order to inhibit melt adhesion of the toner particles, a cooling jacket (106) is disposed on the outer periphery of the toner particle feeding port (100), the outer periphery of the surface treatment apparatus and the outer periphery of a transport conduit (116). Cooling water (preferably an antifreeze solution such as ethylene glycol) preferably flows through this cooling jacket. The toner particles dispersed by the dispersion air are subjected to treatment of the surface of the toner particles by the hot air current fed from a hot air current feeding port (101). At this time, the hot air current temperature C (° C.) is preferably from at least 100° C. to not more than 450° C. More preferably, it is from at least 100° C. to not more than 400° C., particularly preferably from at least 150° C. to not more than 300° C. When a hot air current is fed at the temperature in this range, variability in the surface roughness of the toner particles is suppressed and melt adhesion and coarsening of the toner due to bonding between particles are also suppressed.

After the surface of the toner particles have been treated with the hot air current, the toner particles are cooled by a cold air current fed from a cold air current feeding port (103) that is disposed on the upper periphery of the apparatus. At this time, in order to control the temperature distribution in the apparatus and control the surface state of the toner particles, a cold air current may also be introduced from a second cold air current feeding port (104) that is disposed in a side surface of the main body of the apparatus. For example, a slit shape, louver configuration, porous plate configuration or mesh configuration may be used for the outlet of this second cold air current feeding port (104). The direction of introduction of the cold air current may be, for example, toward the center of the apparatus or along the side wall of the apparatus. At this time, the cold air current temperature E (° C.) is preferably from at least −50° C. to not more than 10° C. More preferably, it is from at least −40° C. to not more than 8° C. In addition, this cold air current is preferably a dehumidified cold air current. Specifically, the cold air current preferably has an absolute moisture content of not more than 5 g/m$^3$. More preferably, it is not more than 3 g/m$^3$.

When a cold air current temperature is in the above-described range, bonding between particles can be inhibited without affecting the heat treatment of the toner particles. The cooled toner particles are thereafter suctioned by a blower through the transport conduit (116) and are recovered by a cyclone.

As necessary, an additional surface modification and spheronizing treatment may be performed using a Hybridization System from Nara Machinery Co., Ltd., or a Mechanofusion System from Hosokawa Micron Corporation. In such a case, a sieving apparatus such as a blow-thru sieve Hi-Bolter (produced by Shin Tokyo Kikai Co., Ltd.) may be used as necessary.

The methods of measuring the various properties of the toner and starting materials are described below.

<Method of Calculating P1 and P2>

The FT-IR spectrum is measured by the ATR procedure using a Fourier-transform infrared spectrophotometer (Spectrum One from PerkinElmer Inc.) equipped with a universal ATR measurement accessory (Universal ATR Sampling Accessory). The specific procedure of measuring P1 and P2, and the method of calculating P1/P2 by dividing P1 by P2 is described below.

The angle of incidence for the infrared radiation (λ=5 μm) is set to 45°. A Ge ATR crystal (refractive index=4.0) and a KRS5 ATR crystal (refractive index=2.4) are used as the ATR crystal. The other conditions are given below.

Range

Start: 4000 cm$^{-1}$

End: 600 cm$^{-1}$ (Ge ATR crystal), 400 cm$^{-1}$ (KRS5 ATR crystal)

Duration

Scan number: 16

Resolution: 4.00 cm$^{-1}$

Advanced: with $CO_2/H_2O$ correction

[Method of Calculating P1]

(1) Mount the Ge ATR crystal (refractive index=4.0) in the apparatus.

(2) Set Scan type to Background and Units to EGY and measure the background.

(3) Set the Scan type to Sample and Units to A.

(4) Precisely weigh out 0.01 g of the toner onto the ATR crystal.

(5) Compress the sample with compressed air. (Force Gauge=90)

(6) Measure the sample.

(7) Perform baseline correction on the obtained FT-IR spectrum with Automatic Correction.

(8) Calculate the maximum value of the absorption peak intensity in the range from 2843 cm$^{-1}$ to 2853 cm$^{-1}$. (Pa1)

(9) Calculate the average value for the absorption intensity at 3050 cm$^{-1}$ and 2600 cm$^{-1}$. (Pa2)

(10) Calculate Pa1−Pa2=Pa. This Pa is defined as the intensity of the highest absorption peak in the range from 2843 cm$^{-1}$ to 2853 cm$^{-1}$.

(11) Calculate the maximum value of the absorption peak intensity in the range from 1713 cm$^{-1}$ to 1723 cm$^{-1}$. (Pb1)

(12) Calculate the average value for the absorption intensity at 1763 cm$^{-1}$ and 1630 cm$^{-1}$. (Pb2)

(13) Calculate Pb1−Pb2=Pb. This Pb is defined as the intensity of the highest absorption peak in the range from 1713 cm$^{-1}$ to 1723 cm$^{-1}$.

(14) Calculate Pa/Pb=P1.

[Method of Calculating P2]

(1) Mount the KRS5 ATR crystal (refractive index=2.4) in the apparatus.

(2) Precisely weigh out 0.01 g of the toner onto the ATR crystal.

(3) Compress the sample with compressed air. (Force Gauge=90)

(4) Measure the sample.

(5) Perform baseline correction on the obtained FT-IR spectrum with Automatic Correction.

(6) Calculate the maximum value of the absorption peak intensity in the range from 2843 cm$^{-1}$ to 2853 cm$^{-1}$. (Pc1)

(7) Calculate the average value for the absorption intensity at 3050 cm$^{-1}$ and 2600 cm$^{-1}$. (Pc2)

(8) Calculate Pc1−Pc2=Pc. This Pc is defined as the intensity of the highest absorption peak in the range from 2843 cm$^{-1}$ to 2853 cm$^{-1}$.

(9) Calculate the maximum value of the absorption peak intensity in the range from 1713 cm$^{-1}$ to 1723 cm$^{-1}$. (Pd1)

(10) Calculate the average value for the absorption intensity at 1763 cm$^{-1}$ and 1630 cm$^{-1}$. (Pd2)

(11) Calculate Pd1−Pd2=Pd. This Pd is defined as the intensity of the highest absorption peak in the range from 1713 cm$^{-1}$ to 1723 cm$^{-1}$.

(12) Calculate Pc/Pd=P2.

[Method of Calculating P1/P2]

Calculate P1/P2 using the P1 and P2 as calculated above.

<Method of Measuring the Softening Point of the Resins>

Measurement of the resin softening point is performed according to the manual provided with the apparatus, using a constant load extrusion-type capillary rheometer from Shimadzu, "Flowtester CFT-500D Flow Property Evaluation Apparatus". With this apparatus, while a constant load is applied to the top of the measurement sample by a piston, the measurement sample filled in a cylinder is heated and melted and the melted measurement sample is extruded from a die at the bottom of the cylinder; a flow curve showing the relationship between piston stroke and temperature can be obtained from this.

In the present invention, the "melting temperature by the ½ method", as described in the manual provided with the "Flowtester CFT-500D Flow Property Evaluation Apparatus", is used as the softening point. The melting temperature by the ½ method is determined as follows. Smax is defined as the piston stroke at the completion of outflow and 5 min is defined as the piston stroke at the start of outflow, ½ of the difference between Smax and 5 min is determined to give the value X (X=(Smax−Smin)/2). The temperature of the flow curve when the piston stroke in the flow curve reaches X is defined as the melting temperature by the ½ method.

The measurement sample is prepared by subjecting approximately 1.0 g of the resin to compression molding for approximately 60 seconds at approximately 10 MPa in a 25° C. atmosphere using a tablet compression molder (for example, NT-100H from NPa System Co., Ltd.) to provide a cylindrical shape with a diameter of approximately 8 mm.

The measurement conditions with the CFT-500D are as follows.

test mode: rising temperature method
start temperature: 50° C.
saturated temperature: 200° C.
measurement interval: 1.0° C.
rate of temperature rise: 4.0° C./min
piston cross section area: 1.000 $cm^2$
test load (piston load): 10.0 kgf (0.9807 MPa)
preheating time: 300 seconds
diameter of die orifice: 1.0 mm
die length: 1.0 mm <Measurement of the Acid Value of the Resins>

The acid value is the number of milligrams of potassium hydroxide required to neutralize the acid present in 1 g of the sample. The acid value of the resin is measured based in JIS K 0070-1992, and the measurement is specifically carried out using the following procedure.

(1) Reagent Preparation

A phenolphthalein solution is obtained by dissolving 1.0 g of phenolphthalein in 90 mL of ethyl alcohol (95 vol %) and adding 100 mL of ion-exchanged water.

7 g of special-grade potassium hydroxide is dissolved in 5 mL of water and adding ethyl alcohol (95 vol %) so that the total volume become one liter. After standing for 3 days in an alkali-resistant container isolated from contact with carbon dioxide, filtration is performed to obtain the potassium hydroxide solution. The obtained potassium hydroxide solution is stored in an alkali-resistant container. The factor for this potassium hydroxide solution is determined as follows: 25 mL of 0.1 mol/L hydrochloric acid is taken to an Erlenmeyer flask; several drops of the above-described phenolphthalein solution are added; titration is performed with the potassium hydroxide solution; and the factor is determined from the amount of the potassium hydroxide solution required for neutralization. The 0.1 mol/L hydrochloric acid prepared based on JIS K 8001-1998 is used.

(2) Procedure (A) the Main Test

A 2.0 g of the pulverized resin sample is precisely weighed into a 200-mL Erlenmeyer flask; 100 mL of a toluene/ethanol (4:1) mixed solution is added; and dissolution is carried out over 5 hours. Several drops of the above-described phenolphthalein solution are added as the indicator and titration is performed using the above-described potassium hydroxide solution. The endpoint for the titration is taken to be the point at which the pale pink color of the indicator persists for approximately 30 seconds.

(B) The Blank Test

Titration is performed using the same procedure as described above, except that the sample is not added (that is, the toluene/ethanol (4:1) mixed solution is titrated by itself).

(3) The acid value is calculated by substituting the obtained results into the following equation.

$$A=[(C-B)\times f\times 5.61]/S$$

wherein

A: acid value (mg KOH/g)

B: amount of addition of the potassium hydroxide solution in the blank test (mL)

C: amount of addition of the potassium hydroxide solution in the main test (mL)

f: factor for the potassium hydroxide solution

S: sample (g)

<Measurement of the Hydroxyl Value of the Resins>

The hydroxyl value is the number of milligrams of potassium hydroxide required to neutralize the acetic acid bonded with the hydroxyl group when 1 g of the sample is acetylated. The hydroxyl value of the binder resin is measured based on JIS K 0070-1992, and the measurement is specifically carried out using the following procedure.

(1) Reagent Preparation 25 g of special-grade acetic anhydride is added into a 100-mL volumetric flask; the total volume is brought to 100 mL by adding pyridine; and thoroughly shaking to provide the acetylating reagent. The obtained acetylating reagent is stored in a brown bottle isolated from contact with humidity, carbon dioxide, and so forth.

A phenolphthalein solution is obtained by dissolving 1.0 g of phenolphthalein in 90 mL of ethyl alcohol (95 vol %) and adding 100 mL of ion-exchanged water.

35 g of special-grade potassium hydroxide is dissolved in 20 mL of water and adding ethyl alcohol (95 vol %) so as that the total volume becomes one liter. After standing for 3 days in an alkali-resistant container isolated from contact with carbon dioxide, filtration is performed to obtain the potassium hydroxide solution. The obtained potassium hydroxide solution is stored in an alkali-resistant container. The factor for this potassium hydroxide solution is determined as follows: 25 mL of 0.5 mol/L hydrochloric acid is taken to an Erlenmeyer flask; several drops of the above-described phenolphthalein solution are added; titration is performed with the potassium hydroxide solution; and the factor is determined from the amount of the potassium hydroxide solution required for neutralization. The 0.5 mol/L hydrochloric acid prepared based on JIS K 8001-1998 is used.

(2) Procedure (A) The Main Test 1.0 g of the pulverized resin sample is precisely weighed into a 200-mL roundbottom flask and exactly 5.0 mL of the above-described acetylating reagent is added with a whole pipette. When the sample is difficult to dissolve in the acetylating reagent, a small amount of special-grade toluene is added to dissolve the sample.

A small funnel is mounted on the mouth of the flask and heating is then carried out by immersing about 1 cm of the bottom of the flask in a glycerol bath at approximately 97° C. In this time, in order to prevent the temperature at the neck of the flask from rising due to the heat from the bath, thick paper in which a round hole has been made is preferably mounted at the base of the neck of the flask.

After 1 hour, the flask is taken off the glycerol bath and allowed to cool. After cooling, the acetic anhydride is hydrolyzed by adding 1 mL of water with the funnel and shaking. In order to accomplish complete hydrolysis, the flask is again heated for 10 minutes on the glycerol bath. After cooling, the funnel and flask walls are washed with 5 mL of ethyl alcohol.

Several drops of the above-described phenolphthalein solution are added as the indicator and titration is performed using the above-described potassium hydroxide solution. The endpoint for the titration is taken to be the point at which the pale pink color of the indicator persists for approximately 30 seconds.

(B) The Blank Test

Titration is performed using the same procedure as described above, except that the binder resin sample is not used.

(3) The hydroxyl value is calculated by substituting the obtained results into the following equation.

$$A=[\{(B-C)\times 28.05\times f\}/S]+D$$

wherein

A: hydroxyl value (mg KOH/g)

B: amount of addition of the potassium hydroxide solution in the blank test (mL)

C: amount of addition of the potassium hydroxide solution in the main test (mL)

f: factor for the potassium hydroxide solution

S: sample (g)

D: acid value of the binder resin (mg KOH/g)

<Method of Measuring the Average Circularity of the Toner and Method of Measuring the Number % of Fine Particles>

The average circularity of the toner and the number % of fine particles in the toner are measured using a flow-type particle image analyzer "FPIA-3000" (Sysmex Corporation); the measurements are performed using the measurement and analysis conditions used during the calibration process.

The flow-type particle image analyzer "FPIA-3000" (Sysmex Corporation) uses a measurement principle based on taking a still image of the flowing particles and performing image analysis. The sample added to the sample chamber is delivered into a flat sheath flow cell by a sample suction syringe. The sample delivered into the flat sheath flow cell is sandwiched by the sheath liquid to form a flat flow. The sample passing through the flat sheath flow cell is exposed to stroboscopic light at an interval of 1/60 second, thus enabling a still image of the flowing particles to be photographed. Moreover, since flat flow is occurring, the photograph is taken under in-focus conditions. The particle image is photographed with a CCD camera, and the photographed image is subjected to image processing at an image processing resolution of 512×512 pixels (0.37×0.37 μm per pixel). Contour definition is performed on each particle image and the projected area S and the periphery length L are measured on the particle image.

The circle-equivalent diameter and circularity are then determined using this area S and periphery length L. The circle-equivalent diameter is the diameter of the circle that has the same area as the projected area of the particle image. The circularity C is defined as the value provided by dividing the circumference of the circle determined from the circle-equivalent diameter by the periphery length of the particle's projected image and is calculated using the following formula.

$$\text{Circularity } C=2\times(\pi\times S)^{1/2}/L$$

The circularity is 1.000 when the particle image is a circle, and the value of the circularity declines as the degree of irregularity in the periphery of the particle image increases. After the circularity of each particle has been calculated, the circularity range of 0.200 to 1.000 is fractionated into 800; the arithmetic average value of the obtained circularities is calculated; and this value is used as the average circularity.

The specific measurement method is as follows. Approximately 20 mL of ion-exchanged water, from which solid impurities and so forth have already been removed, is added into a glass container. To this is added about 0.2 mL of a dilution prepared by the approximately three-fold (mass) dilution with ion-exchanged water of the dispersing agent "Contaminon N" (a 10 mass % aqueous solution (pH 7) of a neutral detergent for cleaning precision measurement instrumentation, comprising a nonionic surfactant, anionic surfactant, and organic builder, from Wako Pure Chemical Industries, Ltd.). Approximately 0.02 g of the measurement sample is also added and a dispersion treatment is carried out for 2 minutes using an ultrasonic disperser to provide a dispersion for measurement. Cooling is carried out as appropriate during this treatment so as to provide a dispersion temperature of at least 10° C. and not more than 40° C. A benchtop ultrasonic cleaner/disperser having an oscillation frequency of 50 kHz and an electrical output of 150 W (for example, "VS-150" from Velvo-Clear Co., Ltd.) is used as the ultrasonic disperser. A prescribed amount of ion-exchanged water is added into the water tank and approximately 2 mL of Contaminon N is added to the water tank.

The above-described flow-type particle image analyzer fitted with a standard objective lens (10×) is used for the measurement, and Particle Sheath "PSE-900A" (Sysmex Corporation) is used for the sheath solution. The dispersion prepared according to the above-described procedure is introduced into the flow-type particle image analyzer and 3,000 toner particles are measured according to total count mode in HPF measurement mode. By setting the binarization threshold value during particle analysis to 85% and specifying the analyzed particle diameter, the number % and average circularity of particles in this range can be calculated. For the proportion of particles having a circle-equivalent diameter of from at least 0.50 μm to less than 1.98 μm (fine particles), the analyzed particle diameter range for the circle-equivalent diameter is set to from at least 0.50 μm to less than 1.98 μm and the number % of particles from at least 0.50 μm to less than 1.98 μm with reference to the particles in the circle-equivalent diameter range from at least 0.50 μm to less than 39.69 μm is calculated. For the average circularity of the toner, the analyzed particle diameter range for the circle-equivalent diameter is set to from at least 1.98 μm to less than 39.69 μm and the average circularity of the toner in this range is determined.

For this measurement, automatic focal point adjustment is performed prior to the start of the measurement using reference latex particles (for example, a dilution with ion-exchanged water of "RESEARCH AND TEST PARTICLES Latex Microsphere Suspensions 5200A" from Duke Scientific). After this, focal point adjustment is preferably performed every two hours after the start of measurement.

In examples of the present application, a flow-type particle image analyzer that had been calibrated by the Sysmex Corporation and that had been issued a calibration certificate by the Sysmex Corporation.

<Method of Measuring the Resin Peak Molecular Weight (Mp), Number-Average Molecular Weight (Mn), and Weight-Average Molecular Weight (Mw)>

The peak molecular weight (Mp), number-average molecular weight (Mn), and weight-average molecular weight (Mw) are measured as follows by gel permeation chromatography (GPC).

First, the sample (resin) is dissolved in tetrahydrofuran (THF) over 24 hours at room temperature. The obtained solution is filtered using a solvent-resistant membrane filter with a pore diameter of 0.2 μm "MYSHORI Disk" (Tosoh Corporation) to obtain a sample solution. The sample solution is adjusted so as to provide a concentration of THF-soluble components of approximately 0.8 mass %. Measurement is performed under the following conditions using this sample solution.

instrument: HLC8120 GPC (detector: RI) (Tosoh Corporation)

columns: 7 column train of Shodex KF-801, 802, 803, 804, 805, 806 and 807 (Showa Denko KK)

eluent: tetrahydrofuran (THF)

flowrate: 1.0 mL/min oven temperature: 40.0° C.

sample injection amount: 0.10 mL

The sample molecular weight is determined using a molecular weight calibration curve constructed using standard polystyrene resin (for example, product name: "TSK Standard Polystyrene F-850, F-450, F-288, F-128, F-80, F-40, F-20, F-10, F-4, F-2, F-1, A-5000, A-2500, A-1000, A-500", from Tosoh Corporation).

<Measurement of the Peak Temperature of the Highest Endothermic Peak of the Wax>

The peak temperature of the highest endothermic peak of the wax is measured based on ASTM D 3418-82 using a differential scanning calorimeter "Q1000" (TA Instruments). The melting points of indium and zinc are used for temperature correction in the instrument's detection section, and the heat of fusion of indium is used to correct the amount of heat.

Specifically, 10 mg of the wax is accurately weighed out and placed in an aluminum pan and the measurement is carried out at a rate of temperature rise of 10° C./min in the measurement temperature range of 30 to 200° C., and using an empty aluminum pan for reference. The measurement is performed by raising the temperature to 200° C., then lowering the temperature to 30° C., and thereafter raising the temperature once again. The temperature indicating highest endothermic peak in the temperature range 30 to 200° C. of the DSC curve in this second temperature raising step is taken to be the peak temperature of the highest endothermic peak of the wax.

<Measurement of the BET Specific Surface Area of the External Additive>

The BET specific surface area of the external additive is measured based in JIS Z8830 (2001). The specific measurement method is as follows.

A "TriStar 3000 Automatic Specific Surface Area • Porosimetry Analyzer" (Shimadzu), which uses gas adsorption by a constant volume procedure as its measurement methodology, is used as the measurement apparatus. The measurement conditions are set and the measurement data is analyzed using "TriStar 3000 Version 4.00", the dedicated software provided with this apparatus. In addition, a vacuum pump, nitrogen gas conduit, and helium gas conduit are connected to the apparatus. The value calculated using a multipoint BET method and nitrogen gas as the adsorption gas is used as the BET specific surface area in the invention.

The BET specific surface area is calculated as follows.

First, nitrogen gas is adsorbed to the external additive and the equilibration pressure P (Pa) within the sample cell and the amount of nitrogen adsorption Va ($mol \cdot g^{-1}$) by the external additive are measured at this time. The adsorption isothermal line is obtained the relative pressure Pr, which is the value provided by dividing the equilibration pressure P (Pa) within the sample cell by the saturation vapor pressure of nitrogen Po (Pa), is used for the horizontal axis, and the amount of nitrogen adsorption Va ($mol \cdot g^{-1}$) is used for the vertical axis. The monomolecular layer adsorption amount Vm ($mol \cdot g^{-1}$), which is the amount of adsorption required to form a monomolecular layer on the surface of the external additive, is then determined using the BET equation provided below.

$$Pr/Va(1-Pr)=1/(Vm\times C)+(C-1)\times Pr/(Vm\times C)$$

(wherein C is the BET parameter and is a variable that changes with the type of measurement sample, the type of adsorption gas, and the adsorption temperature)

The BET formula can be rendered as a straight line, with a slope of (C−1)/(Vm×C) and an intercept of 1/(Vm×C), when Pr is the X-axis and Pr/Va(1−Pr) is the Y-axis (this straight line is called a BET plot).

$$\text{slope of the straight line}=(C-1)/(Vm\times C)$$

$$\text{intercept of the straight line}=1/(Vm\times C)$$

The value of the slope and the value of the intercept for the straight line can be calculated by plotting the measured values of Pr and the measured values of Pr/Va(1−Pr) on a graph and generating a straight line by the least-squares method. Using these values, Vm and C can be calculated by solving the above-described simultaneous equations for the slope and intercept.

The BET specific surface area S ($m^2/g$) of the external additive is then calculated using the following formula and the value of Vm calculated as above and the molecular cross-sectional area of the nitrogen molecule (0.162 $nm^2$)

$$S=Vm\times N\times 0.162\times 10^{-18}$$

(wherein N is Avogadro's number ($mol^{-1}$)).

Measurements using this apparatus are performed according to the "TriStar 3000 Operating Manual V4.0" provided with the apparatus and specifically are performed using the following procedure.

The glass sample cell (stem diameter=⅜ inch, volume=approximately 5 mL) provided with the apparatus is thoroughly cleaned and dried and then precisely weighed to determine the tare value. Approximately 0.1 g of the external additive is added to this sample cell using a funnel.

The external additive-loaded sample cell is set in a "Pretreatment Apparatus Vacuprep 061" (Shimadzu) connected to the vacuum pump and nitrogen gas line and vacuum degassing is carried out for about 10 hours at 23° C. This vacuum degassing is performed by gradually degassing while adjusting the valve in order to avoid suctioning the external additive into the vacuum pump. The pressure in the cell gradually decreases as degassing proceeds and finally reaches to approximately 0.4 Pa (approximately 3 millitorr). After the completion of vacuum degassing, nitrogen gas is gradually added and the interior of the sample cell is returned to atmospheric pressure and the sample cell is removed from the pretreatment apparatus. The mass of this sample cell is accurately weighed and the precise mass of the external additive is calculated from the difference from the tare value. The sample cell is sealed with a rubber stopper during weighing in order to prevent the external additive in the sample cell from being contaminated with, for example, moisture in the atmosphere.

The "isothermal jacket" provided with the apparatus is installed on the stem of this external additive-loaded sample cell. The filler rod provided with the apparatus is inserted into the sample cell and the sample cell is set in the analysis port of the apparatus. This isothermal jacket is a cylindrical element whose inside is composed of a porous material and whose outside is composed of an impermeable material, and it can draw up the liquid nitrogen by capillary phenomena to a prescribed level.

Measurement of the free space in the sample cell including the connection fixtures is then performed. For the free space, the volume of the sample cell is measured at 23° C. using helium gas; then, after the sample cell has been cooled with liquid nitrogen, the volume of the sample cell is similarly measured using helium gas; and the free space is calculated converting from the difference in these volumes. In addition, the saturation vapor pressure Po (Pa) of nitrogen is automatically measured separately using the Po tube built into the apparatus.

Then, after the interior of the sample cell has been vacuum degassed, the sample cell is cooled with liquid nitrogen while vacuum degassing is continued. After this, nitrogen gas is added in stages into the sample cell and the nitrogen molecules are adsorbed to the toner. At this point, the above-described adsorption isothermal line is obtained by measurement of the equilibration pressure P (Pa), and this adsorption isothermal line is converted to a BET plot. The relative pressure Pr points for data collection are set at a total of six points, that is, 0.05, 0.10, 0.15, 0.20, 0.25 and 0.30. A straight line is generated by the least-squares method from the obtained measurement data and Vm is calculated from the slope and intercept of this straight line. Using this value for Vm, the BET specific surface area of the external additive is calculated as described above.

<Method of Measuring the Weight-Average Particle Diameter (D4) of the Toner Particles>

The weight-average particle diameter (D4) of the toner particles is calculated using a precision particle diameter distribution analyzer "Coulter Counter Multisizer 3" (registered trademark of Beckman Coulter, Inc.), which uses the aperture electrical resistance principle and is equipped with a 100 μm aperture tube, and using the "Beckman Coulter Multisizer 3 Version 3.51" software (from Beckman Coulter, Inc.) provided with the apparatus, to perform measurements at 25,000 channels for the number of effective measurement channels and to carry out analysis of the measurement data.

A solution of special-grade sodium chloride dissolved in ion-exchanged water and brought to a concentration of approximately 1 mass %, for example, "ISOTON II" (Beckman Coulter, Inc.), can be used for the aqueous electrolyte solution used for the measurement.

The dedicated software is set as follows prior to performing the measurement and analysis.

On the "Change Standard Operating Method (SOM)" screen of the dedicated software, the total count number for the control mode is set to 50,000 particles, the number of measurements is set to 1, and the value obtained using "10.0 μm standard particles" (from Beckman Coulter, Inc.) is set for the Kd value. The threshold value and noise level are automatically set by pressing the threshold value/noise level measurement button. The current is set to 1600 μA, the gain is set to 2, the electrolyte solution is set to ISOTON II, and "flush aperture tube after measurement" is checked.

On the "pulse-to-particle diameter conversion setting" screen of the dedicated software, the bin interval is set to logarithmic particle diameter, the particle diameter bin is set to 256 particle diameter bins, and the particle diameter range is set to from 2 μm to 60 μm.

The specific measurement method is as follows.

(1) Approximately 200 mL of the above-described aqueous electrolyte solution is added to the glass 250-mL roundbottom beaker provided for use with the Multisizer 3 and this is then set into the sample stand and counterclockwise stirring is performed with a stirring rod at 24 rotations per second. Dirt and bubbles in the aperture tube are removed using the "aperture flush" function of the analytic software.

(2) Approximately 30 mL of the above-described aqueous electrolyte solution is added to a glass 100-mL flatbottom beaker. To this is added the following as a dispersing agent: approximately 0.3 mL of a dilution prepared by diluting "Contaminon N" (which is a 10 mass % aqueous solution of a neutral pH 7 detergent for cleaning precision measurement instrumentation and comprises a nonionic surfactant, an anionic surfactant, and an organic builder, from Wako Pure Chemical Industries, Ltd) three-fold on a mass basis with ion-exchanged water.

(3) A prescribed amount of ion-exchanged water is added to the water tank of an ultrasonic disperser "Ultrasonic Dispersion System Tetora 150" (Nikkaki Bios Co., Ltd.), which has an output of 120 W and is equipped with two oscillators oscillating at 50 kHz and configured with a phase shift of 180°, and approximately 2 mL of the above-described Contaminon N is added to this water tank.

(4) The beaker from (2) is placed in the beaker holder of the ultrasonic disperser and the ultrasonic disperser is activated. The height position of the beaker is adjusted to provide the maximum resonance state for the surface of the aqueous electrolyte solution in the beaker.

(5) While exposing the aqueous electrolyte solution in the beaker of (4) to the ultrasonic, approximately 10 mg of the toner is added in small portions to the aqueous electrolyte solution and is dispersed. The ultrasonic dispersing treatment is continued for another 60 seconds. During ultrasonic dispersion, the water temperature in the water tank is adjusted as appropriate to be at least 10° C. but not more than 40° C.

(6) Using a pipette, the aqueous electrolyte solution from (5) containing dispersed toner is added dropwise into the roundbottom beaker of (1) that is installed in the sample stand and the measurement concentration is adjusted to approximately 5%. The measurement is run until the number of particles measured reaches 50,000.

(7) The measurement data is analyzed by the dedicated software provided with the apparatus to calculate the weight-average particle diameter (D4). When the dedicated software is set to graph/volume %, the "average diameter" on the analysis/volume statistics (arithmetic average) screen is the weight-average particle diameter (D4).

EXAMPLES

In examples, "parts" and "%" are on a mass basis in the absence of a specific designation.

Polyester Resin Production Example A-1

75.0 mass parts (0.167 mol) of polyoxypropylene(2.2)-2,2-bis(4-hydroxyphenyl)propane, 24.0 mass parts (0.145 mol) of terephthalic acid, and 0.5 mass part of titanium tetrabutoxide were added to a glass 4-L four-neck flask and this was fitted with a thermometer, stirrer, condenser, and nitrogen inlet tube and set in a mantle heater. The inside of the flask was then substituted with nitrogen gas, after which the temperature was gradually raised while stirring and a reaction was performed for 4 hours while stirring at a temperature of 200° C. (first reaction step). 2.0 mass parts (0.010 mol) of trimellitic anhydride was subsequently added and a reaction was performed for 2 hours at 180° C. (second reaction step) to obtain polyester resin A-1.

This resin A-1 had an acid value of 10 mg KOH/g and a hydroxyl value of 65 mg KOH/g. Its molecular weight by GPC was as follows: weight-average molecular weight (Mw)=8,000; number-average molecular weight (Mn)=3,500; and peak molecular weight (Mp)=5,700. It had a softening point of 90° C.

Polyester Resin Production Example A-2

A polyester resin A-2 was obtained in the same manner as in Polyester Resin Production Example A-1, except that the amount of addition of the trimellitic anhydride in the second reaction step was changed to 3.0 mass parts (0.016 mol).

This resin A-2 had an acid value of 30 mg KOH/g and a hydroxyl value of 45 mg KOH/g. Its molecular weight by GPC was as follows: weight-average molecular weight (Mw)=7,800; number-average molecular weight (Mn)=3,400; and peak molecular weight (Mp)=5,200. It had a softening point of 85° C.

Polyester Resin Production Example A-3

A polyester resin A-3 was obtained in the same manner as in Polyester Resin Production Example A-1, except that the reaction time in the first reaction step was changed to 3 hours.

This resin A-3 had an acid value of 15 mg KOH/g and a hydroxyl value of 83 mg KOH/g. Its molecular weight by GPC was as follows: weight-average molecular weight (Mw)=7,600; number-average molecular weight (Mn)=3,300; and peak molecular weight (Mp)=4,500. It had a softening point of 77° C.

Polyester Resin Production Example A-4

A polyester resin A-4 was obtained in the same manner as in Polyester Resin Production Example A-1, except that the reaction time in the first reaction step was changed to 2 hours.

This resin A-4 had an acid value of 20 mg KOH/g and a hydroxyl value of 88 mg KOH/g. Its molecular weight by GPC was as follows: weight-average molecular weight (Mw)=7,400; number-average molecular weight (Mn)=3,200; and peak molecular weight (Mp)=4,300. It had a softening point of 72° C.

Polyester Resin Production Example A-5

A polyester resin A-5 was obtained in the same manner as in Polyester Resin Production Example A-1, except that the reaction time in the first reaction step was changed to 6 hours and the amount of addition of the trimellitic anhydride in the second reaction step was changed to 3.0 mass parts (0.016 mol).

This resin A-5 had an acid value of 40 mg KOH/g and a hydroxyl value of 28 mg KOH/g. Its molecular weight by GPC was as follows: weight-average molecular weight (Mw)=8,200; number-average molecular weight (Mn)=3,600; and peak molecular weight (Mp)=6,100. It had a softening point of 100° C.

Polyester Resin Production Example A-6

A polyester resin A-6 was obtained in the same manner as in Polyester Resin Production Example A-1, except that the reaction time in the first reaction step was changed to 1.5 hours.

This resin A-6 had an acid value of 28 mg KOH/g and a hydroxyl value of 100 mg KOH/g. Its molecular weight by GPC was as follows: weight-average molecular weight (Mw)=6,900; number-average molecular weight (Mn)=2,800; and peak molecular weight (Mp)=3,900. It had a softening point of 67° C.

The properties of polyester resins A-1 to A-6 are shown in Table 1.

TABLE 1

| | acid value (mgKOH/g) | hydroxyl value (mgKOH/g) | Mw | Mn | Mp | softening point (° C.) |
|---|---|---|---|---|---|---|
| A-1 | 10 | 65 | 8,000 | 3,500 | 5,700 | 90 |
| A-2 | 30 | 45 | 7,800 | 3,400 | 5,200 | 85 |
| A-3 | 15 | 83 | 7,600 | 3,300 | 4,500 | 77 |
| A-4 | 20 | 88 | 7,400 | 3,200 | 4,300 | 72 |
| A-5 | 40 | 28 | 8,200 | 3,600 | 6,100 | 100 |
| A-6 | 28 | 100 | 6,900 | 2,800 | 3,900 | 67 |

Polyester Resin Production Example B-1

40.0 mass parts (0.526 mol) of 1,2-propylene glycol, 55.0 mass parts (0.331 mol) of terephthalic acid, 1.0 mass part (0.007 mol) of adipic acid, and 0.6 mass part of titanium tetrabutoxide were added to a glass 4-L four-neck flask. This four-neck flask was fitted with a thermometer, stirrer, condenser, and nitrogen inlet tube and the four-neck flask was set in a mantle heater. The inside of the four-neck flask was then substituted with nitrogen gas, after which the temperature was gradually raised to 220° C. while stirring and a reaction was performed for 8 hours (first reaction step). 4.0 mass parts (0.021 mol) of trimellitic anhydride was subsequently added and a reaction was performed for 4 hours at 180° C. (second reaction step) to obtain polyester resin B-1.

This resin B-1 had an acid value of 15 mg KOH/g and a hydroxyl value of 7 mg KOH/g. Its molecular weight by GPC was as follows: weight-average molecular weight (Mw)=200,000; number-average molecular weight (Mn)=5,000; and peak molecular weight (Mp)=10,000. It had a softening point of 130° C.

Polyester Resin Production Example B-2

A polyester resin B-2 was obtained in the same manner as in Polyester Resin Production Example B-1, except that the reaction time in the second reaction step was changed to 3 hours.

This resin B-2 had an acid value of 20 mg KOH/g and a hydroxyl value of 12 mg KOH/g. Its molecular weight by GPC was as follows: weight-average molecular weight (Mw)=190,000; number-average molecular weight (Mn)=4,900; and peak molecular weight (Mp)=9,800. It had a softening point of 125° C.

Polyester Resin Production Example B-3

A polyester resin B-3 was obtained in the same manner as in Polyester Resin Production Example B-1, except that the reaction time in the second reaction step was changed to 2 hours.

This resin B-3 had an acid value of 25 mg KOH/g and a hydroxyl value of 17 mg KOH/g. Its molecular weight by GPC was as follows: weight-average molecular weight (Mw)=180,000; number-average molecular weight (Mn)=4,800; and peak molecular weight (Mp)=9,700. It had a softening point of 115° C.

Polyester Resin Production Example B-4

A polyester resin B-4 was obtained in the same manner as in Polyester Resin Production Example B-1, except that the reaction time in the second reaction step was changed to 1.5 hours.

This resin B-4 had an acid value of 30 mg KOH/g and a hydroxyl value of 25 mg KOH/g. Its molecular weight by GPC was as follows: weight-average molecular weight (Mw)=150,000; number-average molecular weight (Mn)=4,600; and peak molecular weight (Mp)=9,500. It had a softening point of 105° C.

Polyester Resin Production Example B-5

A Polyester Resin B-5 was obtained in the same manner as in Polyester Resin Production Example B-1, except that the reaction time in the second reaction step was changed to 6 hours and the amount of addition of the trimellitic anhydride was changed to 6.0 mass parts (0.031 mol).

This resin B-5 had an acid value of 20 mg KOH/g and a hydroxyl value of 5 mg KOH/g. Its molecular weight by GPC was as follows: weight-average molecular weight (Mw)=220,000; number-average molecular weight (Mn)=5,200; and peak molecular weight (Mp)=11,000. It had a softening point of 148° C.

Polyester Resin Production Example B-6

A Polyester Resin B-6 was obtained in the same manner as in Polyester Resin Production Example B-1, except that the reaction time in the second reaction step was changed to 8 hours and the amount of addition of the trimellitic anhydride was changed to 7.0 mass parts (0.036 mol).

This resin B-6 had an acid value of 15 mg KOH/g and a hydroxyl value of 5 mg KOH/g. Its molecular weight by GPC was as follows: weight-average molecular weight (Mw)=230,000; number-average molecular weight (Mn)=5,300; and peak molecular weight (Mp)=11,000. It had a softening point of 156° C.

Polyester Resin Production Example B-7

A polyester resin B-7 was obtained in the same manner as in Polyester Resin Production Example B-1, except that the reaction time in the second reaction step was changed to 1.0 hour.

This resin B-7 had an acid value of 10 mg KOH/g and a hydroxyl value of 35 mg KOH/g. Its molecular weight by GPC was as follows: weight-average molecular weight (Mw)=120,000; number-average molecular weight (Mn)=4,500; and peak molecular weight (Mp)=9,300. It had a softening point of 105° C.

The properties of polyester resins B-1 to B-7 are shown in Table 2.

TABLE 2

| | acid value (mgKOH/g) | hydroxyl value (mgKOH/g) | Mw | Mn | Mp | softening point (° C.) |
|---|---|---|---|---|---|---|
| B-1 | 15 | 7 | 200,000 | 5,000 | 10,000 | 130 |
| B-2 | 20 | 12 | 190,000 | 4,900 | 9,800 | 125 |
| B-3 | 25 | 17 | 180,000 | 4,800 | 9,700 | 115 |
| B-4 | 30 | 25 | 150,000 | 4,600 | 9,500 | 105 |
| B-5 | 20 | 5 | 220,000 | 5,200 | 11,000 | 148 |
| B-6 | 15 | 5 | 230,000 | 5,300 | 11,000 | 156 |
| B-7 | 10 | 35 | 120,000 | 4,500 | 9,300 | 105 |

Toner Production Example 1

| | |
|---|---|
| polyester resin A-1 | 70 mass parts |
| polyester resin B-1 | 30 mass parts |
| Fischer-Tropsch wax (peak temperature of the highest endothermic peak = 78° C.) | 5 mass parts |
| carbon black (number-average particle diameter = 30 nm, DBP absorption = 50 mL/100 g, pH = 9.0) | 5 mass parts |
| an aluminum 3,5-di-t-butylsalicylate compound | 0.5 mass part |
| hydrophobic fine silica particles (fine silica particles with a BET specific surface area of 200 $m^2/g$, surface-treated with 16 mass % hexamethyldisilazane) | 2.0 mass parts |

The above materials mixed with a Henschel mixer (model FM-75, from Mitsui Miike Chemical Engineering Machinery Co., Ltd.) and then mixed/kneaded at a rotation rate of 1.0 $s^{-1}$ and a residence time of approximately 2 minutes using an open roll continuous mixer/kneader (from Mitsui Mining Co., Ltd., trade name: Kneadex). The obtained mixture was cooled and coarsely pulverized to 1 mm and below with a hammer mill to obtain a coarse pulverizate. The obtained coarse pulverizate was finely pulverized using a mechanical grinder (T-250, from Turbo Kogyo Co., Ltd.). Classification was performed using a rotary classifier (200TSP, from Hosokawa Micron Corporation) to obtain toner particles 1. With regard to the operating conditions for the rotary classifier (200TSP, from Hosokawa Micron Corporation), the rotation rate for the classifier rotor was set at 50.0 $s^{-1}$. The obtained toner particles 1 had a weight-average particle diameter (D4) of 5.8 μm.

A surface treatment was performed on toner particles 1 using the surface treatment apparatus shown in FIG. 1. The operating conditions were as follows: feed rate=5 kg/hr; hot air current temperature C=250° C.; hot air current flow rate=6 $m^3$/min; cold air current temperature E=5° C.; cold air current feed rate=4 $m^3$/min; absolute amount of moisture in the cold air current=3 g/$m^3$; blower air current rate=20 $m^3$/min; and injection air flow rate=1 $m^3$/min. The resulting treated toner particles 1 had an average circularity of 0.965 and a weight-average particle diameter (D4) of 6.2 μm.

To 100 mass parts of the treated toner particles 1 were added 0.5 mass part of a finely divided titanium oxide that had a BET specific surface area of 60 $m^2/g$ and had been subjected to a surface treatment with 15 mass % isobutyltrimethoxysilane, 0.8 mass part of a hydrophobic finely divided silica that had a BET specific surface area of 130 $m^2/g$ and had been subjected to a surface treatment with 20 mass % hexamethyldisilazane, and 1.0 mass part of a hydrophobic finely divided silica that had a BET specific surface area of 25 $m^2/g$ and had been subjected to a surface treatment with 4 mass % hexamethyldisilazane, and mixing with a Henschel mixer (model FM-75, from Mitsui Miike Chemical Engineering Machinery Co., Ltd.) then yielded a toner 1.

Toner 1 had P1/P2=1.33 and an average circularity of 0.965 and had 3.0 number % particles from at least 0.50 μm to not more than 1.98 μm (fine particle toner). The properties of the obtained toner 1 are shown in Table 3.

Toner Production Examples 2 to 4

Toners 2 to 4 were obtained in the same manner as in Toner Production Example 1, except for adjusting the classification rotor rotation rate of the rotary classifier (200TSP, from Hosokawa Micron Corporation) used in Toner Production Example 1 to 45.8 $s^{-1}$ in Production Example 2, 41.7 $s^{-1}$ in Production Example 3, and 37.5 $s^{-1}$ in Production Example 4, respectively. The properties of the obtained toners 2 to 4 are shown in Table 3.

Toner Production Examples 5 to 8

Toners 5 to 8 were obtained in the same manner as in Toner Production Example 4, except for adjusting the hot air current temperature during surface treatment in Toner Production Example 4 with the surface treatment apparatus shown in FIG. 1 to 260° C. in Production Example 5, 240° C. in Production Example 6, 280° C. in Production Example 7, and 210° C. in Production Example 8, respectively. The properties of the obtained toners 5 to 8 are shown in Table 3.

Toner Production Examples 9 to 24

Toners 9 to 24 were obtained in the same manner as in Toner Production Example 8, except for changing the polyester resin A, polyester resin B, and blending ratio therebetween in Toner Production Example 8 as shown in Table 3. The properties of the obtained toners 9 to 24 are shown in Table 3.

Toner Production Example 25

Toner 25 was obtained in the same manner as in Toner Production Example 24, except for carrying out the surface treatment in Toner Production Example 24 using a Hybridizer (Nara Machinery Co., Ltd.) rather than performing surface treatment with the surface treatment apparatus shown in FIG. 1. The properties of the obtained toner 25 are shown in Table 3.

Toner Production Example 26

Toner 26 was obtained in the same manner as in Toner Production Example 24, except for changing the wax used in Toner Production Example 24 to 5 mass parts of purified carnauba wax (peak temperature of the highest endothermic peak=83.4° C.), changing the amount of addition of the hydrophobic fine silica particles (the fine silica particles with a BET specific surface area of 200 $m^2/g$ that had been surface-treated with 16 mass % hexamethyldisilazane) in Toner Production Example 24 to 4.0 mass parts, and changing the temperature of the hot air current in Toner Production Example 24 to 280° C. The properties of the obtained toner 26 are shown in Table 3.

Toner Production Example 27

Toner 27 was obtained in the same manner as in Toner Production Example 24, except for changing the wax used in Toner Production Example 24 to 2 mass parts of polypropylene wax (peak temperature of the highest endothermic peak=140° C.). The properties of the obtained toner 27 are shown in Table 3.

Toner Production Example 28

Toner 28 was obtained in the same manner as in Toner Production Example 24, except for changing the wax used in Toner Production Example 24 to 10 mass parts of purified carnauba wax (peak temperature of the highest endothermic peak=83.4° C.), changing the amount of addition of the hydrophobic fine silica particles (the fine silica particles with a BET specific surface area of 200 $m^2/g$ that had been surface-treated with 16 mass % hexamethyldisilazane) in Toner Production Example 24 to 4.0 mass parts, and changing the temperature of the hot air current in Toner Production Example 24 to 280° C. The properties of the obtained toner 28 are shown in Table 3.

Toner Production Example 29

Toner 29 was obtained in the same manner as in Toner Production Example 1, except for changing the device used in the pulverization step in Toner Production Example 1 from the mechanical grinder (T-250, from Turbo Kogyo Co., Ltd.) to a jet-type pulverizer and also not carrying out surface treatment using the surface treatment apparatus shown in FIG. 1. The properties of the obtained toner 29 are shown in Table 3.

Toner Production Example 30

Toner 30 was obtained in the same manner as in Toner Production Example 1, except for changing the wax used in Toner Production Example 1 to 10 mass parts of the Fischer-Tropsch wax (peak temperature of the highest endothermic peak=78° C.), not adding the hydrophobic fine silica particles (the hydrophobic fine silica particles with a BET specific surface area of 200 $m^2/g$ that had been surface-treated with 16 mass % hexamethyldisilazane), and changing the temperature of the hot air current in Toner Production Example 1 to 280° C. The properties of the obtained toner 30 are shown in Table 3.

Toner Production Examples 31 and 32

Toners 31 and 32 were obtained in the same manner as in Toner Production Example 1, except for changing the polyester resin A, polyester resin B, and blending ratio therebetween in Toner Production Example 1 as shown in Table 3. The properties of the obtained toners 31 and 32 are shown in Table 3.

TABLE 3

| | | polyester resin A | mass parts | polyester resn B | mass parts | P1 | P2 | P1/P2 | average circularity | fine particle proortion (number %) |
|---|---|---|---|---|---|---|---|---|---|---|
| Example 1 | Toner 1 | A-1 | 70 | B-1 | 30 | 0.24 | 0.18 | 1.33 | 0.965 | 3.0% |
| Example 2 | Toner 2 | A-1 | 70 | B-1 | 30 | 0.24 | 0.18 | 1.33 | 0.965 | 8.0% |
| Example 3 | Toner 3 | A-1 | 70 | B-1 | 30 | 0.24 | 0.18 | 1.33 | 0.965 | 12.0% |
| Example 4 | Toner 4 | A-1 | 70 | B-1 | 30 | 0.24 | 0.18 | 1.33 | 0.965 | 17.0% |
| Example 5 | Toner 5 | A-1 | 70 | B-1 | 30 | 0.26 | 0.18 | 1.44 | 0.975 | 17.0% |
| Example 6 | Toner 6 | A-1 | 70 | B-1 | 30 | 0.22 | 0.18 | 1.22 | 0.955 | 17.0% |
| Example 7 | Toner 7 | A-1 | 70 | B-1 | 30 | 0.30 | 0.18 | 1.67 | 0.985 | 17.0% |
| Example 8 | Toner 8 | A-1 | 70 | B-1 | 30 | 0.21 | 0.18 | 1.17 | 0.950 | 17.0% |
| Example 9 | Toner 9 | A-1 | 70 | B-2 | 30 | 0.29 | 0.18 | 1.61 | 0.950 | 17.0% |
| Example 10 | Toner 10 | A-1 | 70 | B-3 | 30 | 0.29 | 0.18 | 1.61 | 0.950 | 17.0% |
| Example 11 | Toner 11 | A-1 | 70 | B-4 | 30 | 0.29 | 0.18 | 1.61 | 0.950 | 17.0% |
| Example 12 | Toner 12 | A-1 | 70 | B-5 | 30 | 0.29 | 0.18 | 1.61 | 0.950 | 17.0% |
| Example 13 | Toner 13 | A-1 | 70 | B-6 | 30 | 0.29 | 0.18 | 1.61 | 0.950 | 17.0% |
| Example 14 | Toner 14 | A-1 | 70 | B-7 | 30 | 0.29 | 0.18 | 1.61 | 0.950 | 17.0% |
| Example 15 | Toner 15 | A-2 | 70 | B-7 | 30 | 0.29 | 0.18 | 1.61 | 0.950 | 17.0% |
| Example 16 | Toner 16 | A-3 | 70 | B-7 | 30 | 0.29 | 0.18 | 1.61 | 0.950 | 17.0% |
| Example 17 | Toner 17 | A-4 | 70 | B-7 | 30 | 0.29 | 0.18 | 1.61 | 0.950 | 17.0% |
| Example 18 | Toner 18 | A-5 | 70 | B-7 | 30 | 0.29 | 0.18 | 1.61 | 0.950 | 17.0% |
| Example 19 | Toner 19 | A-6 | 70 | B-7 | 30 | 0.29 | 0.18 | 1.61 | 0.950 | 17.0% |
| Example 20 | Toner 20 | A-6 | 62 | B-7 | 38 | 0.25 | 0.17 | 1.47 | 0.950 | 17.0% |
| Example 21 | Toner 21 | A-6 | 85 | B-7 | 15 | 0.31 | 0.19 | 1.63 | 0.950 | 17.0% |
| Example 22 | Toner 22 | A-6 | 53 | B-7 | 47 | 0.23 | 0.17 | 1.35 | 0.950 | 17.0% |
| Example 23 | Toner 23 | A-6 | 95 | B-7 | 5 | 0.32 | 0.18 | 1.78 | 0.950 | 17.0% |
| Example 24 | Toner 24 | A-6 | 50 | B-7 | 50 | 0.22 | 0.17 | 1.29 | 0.950 | 17.0% |
| Example 25 | Toner 25 | A-6 | 50 | B-7 | 50 | 0.18 | 0.16 | 1.13 | 0.960 | 17.0% |
| Example 26 | Toner 26 | A-6 | 50 | B-7 | 50 | 0.40 | 0.22 | 1.82 | 0.985 | 17.0% |
| Example 27 | Toner 27 | A-6 | 50 | B-7 | 50 | 0.17 | 0.16 | 1.06 | 0.940 | 17.0% |
| Example 28 | Toner 28 | A-6 | 50 | B-7 | 50 | 0.48 | 0.25 | 1.92 | 0.985 | 17.0% |
| Comparative Example 1 | Toner 29 | A-1 | 70 | B-1 | 30 | 0.16 | 0.16 | 1.00 | 0.930 | 3.0% |
| Comparative Example 2 | Toner 30 | A-1 | 70 | B-1 | 30 | 0.62 | 0.30 | 2.07 | 0.985 | 3.0% |
| Comparative Example 3 | Toner 31 | — | 0 | B-1 | 100 | 0.33 | 0.18 | 1.83 | 0.965 | 3.0% |
| Comparative Example 4 | Toner 32 | A-1 | 100 | — | 0 | 0.21 | 0.16 | 1.31 | 0.965 | 3.0% |

Example 1

Comparative Example 1

Example 1

A two-component developer 1 was obtained by mixing magnetic ferrite carrier particles (number-average particle diameter of 35 μm) which surface is coated with a silicone resin, with toner 1 to provide a toner concentration of 6 mass %.

The evaluation tests shown below were carried out using the resulting two-component developer 1.

<Evaluation of the Fixing Performance (Low-Temperature Fixability and Hot Offset Resistance)>

Testing of the fixation temperature region was performed using a full-color copier "imagePress C1" (Canon Inc.) that had been modified to enable free selection of the fixation temperature. For the image, an unfixed image having a 25% image print coverage rate was produced in single-color mode in a normal temperature/normal humidity environment (23° C./50% RH) with the toner laid-on level onto the paper adjusted to 1.2 mg/cm$^2$. The paper used in the evaluation was copy paper "CS-814" (A4, areal weight=81.4 g/m$^2$, commercial product from Canon Marketing Japan Inc.). Fixing was performed in a normal temperature/normal humidity environment (23° C./50% RH) with the fixation temperature being raised in 5° C. increments in sequence from 100° C. The obtained image was rubbed 5 times back-and-forth with lens-cleaning paper (DASPER® Lens Cleaning Paper from Ozu Paper Co., Ltd.) under a load of 50 g/cm$^2$. The lower limit temperature was taken to be the temperature at which the decline in the image density pre-versus-post-rubbing reached 5% or less, and the low-temperature fixability was evaluated using this temperature. In addition, the upper limit temperature was taken to be the temperature at which, as the fixation temperature was ramped up, the appearance of offset was observed, and the hot offset resistance was evaluated using this temperature. The results of the evaluations are shown in Table 4.

<Evaluation of the Resistance to Wraparound During Fixing>

The evaluation instrumentation used in the above-described fixing performance evaluation was used. The paper used in the evaluation was GF-500 (A4, areal weight=64.0 g/m$^2$, commercial product from Canon Marketing Japan Inc.). 10 prints of an unfixed image were produced at a width of 60 mm in the paper feed direction at a position 1 mm from the edge with the toner laid-on level onto the paper adjusted to 1.2 mg/cm$^2$.

The fixation temperature was set to 160° C. and the 10 sheets were fed continuously at 100 mm/sec, and the determination was made as to whether wrapping around the fixing member occurred. The evaluation was performed using the scale given below. The results of the evaluation are shown in Table 4.

A: wrapping around the fixing member was entirely absent

B: separation could be performed by the fixing separation pawl; no problems occurred and there was also no striping in the fixed image C: separation could be performed by the fixing separation pawl, but some striping was produced in the fixed image D: separation could not be performed by the fixing separation pawl and jamming occurred <Evaluation of the Developing Performance>

A modified full-color copying machine "imagePress C1" (Canon Inc.) was used as the image-forming apparatus, and the above-described two-component developer 1 was introduced into the developing device at the black station.

Image output durability testing evaluation (A4 width, 80% print coverage rate, 1,000 continuously fed sheets) was carried out in a normal temperature/normal humidity environment (23° C., 50% RH), in a normal temperature/low humidity environment (23° C., 5% RH), and in a high temperature/high humidity environment (32.5° C., 80% RH). During the continuous feed of the 1,000 sheets of paper, paper feed is carried out at the same developing conditions and transfer conditions as for the first sheet. The paper used in the evaluation was copy paper "CS-814" (A4, areal weight=81.4 g/m$^2$, commercial product from Canon Marketing Japan Inc.). Adjustment was made such that, under the above-described evaluation conditions, the toner laid-on level onto the paper for the FFH image (solid black image) was 0.4 mg/cm$^2$. The FFH image is the value of gradation 256 on a hexadecimal scale, wherein gradation 1 (white background region) is OOH and gradation 256 (solid black region) is FFH.

(Image density measurement, initial (print 1) and after the continuous feed of 1,000 sheets)

Using a color reflectance densitometer "X-Rite" (500 Series, from X-Rite, Incorporated), the image density was measured on the solid black region, both initially (print 1) and after the continuous feed of 1,000 sheets, and the difference between the image density for the initial image (print 1) and the image on print 1,000 was calculated. The evaluation was performed using the following scale.

(Evaluation Scale)

A: the image density difference is less than 0.05

B: the image density difference is at least 0.05 but less than 0.10

C: the image density difference is at least 0.10 but less than 0.20

D: the image difference is at least 0.20

(Fogging measurement, initial (print 1) and after the continuous feed of 1,000 sheets)

The average reflectance Dr (%) of the evaluation paper prior to image output was measured with a reflectometer (REFLECTOMETER MODEL TC-6DS from Tokyo Denshoku Co., Ltd.). The reflectance Ds (%) of the white background region was also measured, both for the initial image (print 1) and for the image on print 1,000. The fogging was calculated using the following formula from the obtained Dr and Ds (initial (print 1) and print 1,000) and was evaluated according to the evaluation scale given below.

$$\text{fogging}(\%)=Dr(\%)-Ds(\%)$$

The results of these evaluations are given in Table 5 (normal temperature/normal humidity environment (23° C., 50% RH)), Table 6 (normal temperature/low humidity environment (23° C., 5% RH)), and Table 7 (high temperature/high humidity environment (32.5° C., 80% RH)).

Examples 2 to 28 and Comparative Examples 1 to 4

Evaluations were performed proceeding as in Example 1 using the same settings and conditions as in Example 1, but changing the toner undergoing evaluation to the toners described in Table 3. The results of the evaluations are shown in Tables 4, 5, 6, and 7.

TABLE 4

| | | low-temperature fixability (° C.) | hot offset resistance (° C.) | resistance to wraparound during fixing |
|---|---|---|---|---|
| Example 1 | Toner 1 | 130 | 220 | A |
| Example 2 | Toner 2 | 130 | 220 | A |
| Example 3 | Toner 3 | 130 | 220 | A |
| Example 4 | Toner 4 | 130 | 220 | A |
| Example 5 | Toner 5 | 130 | 220 | A |
| Example 6 | Toner 6 | 130 | 220 | A |
| Example 7 | Toner 7 | 130 | 220 | A |
| Example 8 | Toner 8 | 130 | 220 | B |
| Example 9 | Toner 9 | 140 | 210 | A |
| Example 10 | Toner 10 | 140 | 200 | A |
| Example 11 | Toner 11 | 140 | 190 | A |
| Example 12 | Toner 12 | 150 | 230 | A |
| Example 13 | Toner 13 | 160 | 240 | A |
| Example 14 | Toner 14 | 140 | 195 | A |
| Example 15 | Toner 15 | 130 | 190 | A |
| Example 16 | Toner 16 | 120 | 180 | A |
| Example 17 | Toner 17 | 120 | 175 | A |
| Example 18 | Toner 18 | 150 | 200 | A |
| Example 19 | Toner 19 | 120 | 170 | A |
| Example 20 | Toner 20 | 130 | 175 | A |
| Example 21 | Toner 21 | 130 | 170 | B |
| Example 22 | Toner 22 | 130 | 180 | A |
| Example 23 | Toner 23 | 130 | 165 | C |
| Example 24 | Toner 24 | 140 | 185 | A |
| Example 25 | Toner 25 | 140 | 185 | C |
| Example 26 | Toner 26 | 150 | 185 | C |
| Example 27 | Toner 27 | 140 | 185 | C |
| Example 28 | Toner 28 | 150 | 185 | C |
| Comparative Example 1 | Toner 29 | 130 | 220 | D |
| Comparative Example 2 | Toner 30 | 130 | 220 | A |
| Comparative Example 3 | Toner 31 | 170 | 240 | A |
| Comparative Example 4 | Toner 32 | 130 | 165 | D |

TABLE 5

(normal temperature/normal humidity environment (23° C., 50% RH))

| | | density | | density | evaluation | fogging | |
|---|---|---|---|---|---|---|---|
| | | print 1 | print 1000 | difference | rank | print 1 | print 1000 |
| Example 1 | Toner 1 | 1.45 | 1.45 | 0.00 | A | 0.2 | 0.2 |
| Example 2 | Toner 2 | 1.45 | 1.45 | 0.00 | A | 0.2 | 0.2 |
| Example 3 | Toner 3 | 1.45 | 1.45 | 0.00 | A | 0.2 | 0.3 |
| Example 4 | Toner 4 | 1.45 | 1.43 | 0.02 | A | 0.2 | 0.3 |
| Example 5 | Toner 5 | 1.45 | 1.43 | 0.02 | A | 0.2 | 0.3 |
| Example 6 | Toner 6 | 1.45 | 1.43 | 0.02 | A | 0.2 | 0.3 |
| Example 7 | Toner 7 | 1.45 | 1.43 | 0.02 | A | 0.2 | 0.3 |

TABLE 5-continued

| (normal temperature/normal humidity environment (23° C., 50% RH)) | | | | | | | |
|---|---|---|---|---|---|---|---|
| | | density | | density | evaluation | fogging | |
| | | print 1 | print 1000 | difference | rank | print 1 | print 1000 |
| Example 8 | Toner 8 | 1.44 | 1.42 | 0.02 | A | 0.2 | 0.3 |
| Example 9 | Toner 9 | 1.44 | 1.41 | 0.03 | A | 0.2 | 0.3 |
| Example 10 | Toner 10 | 1.44 | 1.41 | 0.03 | A | 0.2 | 0.3 |
| Example 11 | Toner 11 | 1.44 | 1.41 | 0.03 | A | 0.2 | 0.3 |
| Example 12 | Toner 12 | 1.44 | 1.41 | 0.03 | A | 0.3 | 0.3 |
| Example 13 | Toner 13 | 1.44 | 1.41 | 0.03 | A | 0.3 | 0.3 |
| Example 14 | Toner 14 | 1.44 | 1.40 | 0.04 | A | 0.3 | 0.3 |
| Example 15 | Toner 15 | 1.44 | 1.40 | 0.04 | A | 0.3 | 0.3 |
| Example 16 | Toner 16 | 1.43 | 1.40 | 0.03 | A | 0.3 | 0.3 |
| Example 17 | Toner 17 | 1.43 | 1.38 | 0.05 | B | 0.3 | 0.3 |
| Example 18 | Toner 18 | 1.47 | 1.41 | 0.06 | B | 0.3 | 0.4 |
| Example 19 | Toner 19 | 1.50 | 1.44 | 0.06 | B | 0.3 | 0.4 |
| Example 20 | Toner 20 | 1.46 | 1.40 | 0.06 | B | 0.3 | 0.4 |
| Example 21 | Toner 21 | 1.47 | 1.40 | 0.07 | B | 0.3 | 0.4 |
| Example 22 | Toner 22 | 1.45 | 1.38 | 0.07 | B | 0.4 | 0.4 |
| Example 23 | Toner 23 | 1.42 | 1.35 | 0.07 | B | 0.3 | 0.4 |
| Example 24 | Toner 24 | 1.44 | 1.37 | 0.07 | B | 0.4 | 0.4 |
| Example 25 | Toner 25 | 1.48 | 1.39 | 0.09 | B | 0.4 | 0.4 |
| Example 26 | Toner 26 | 1.49 | 1.36 | 0.13 | C | 0.5 | 0.8 |
| Example 27 | Toner 27 | 1.40 | 1.31 | 0.09 | B | 0.4 | 0.6 |
| Example 28 | Toner 28 | 1.45 | 1.32 | 0.13 | C | 0.6 | 0.9 |
| Comparative Example 1 | Toner 29 | 1.35 | 1.26 | 0.09 | B | 0.3 | 0.7 |
| Comparative Example 2 | Toner 30 | 1.50 | 1.30 | 0.20 | D | 1.5 | 2.2 |
| Comparative Example 3 | Toner 31 | 1.58 | 1.30 | 0.28 | D | 1.3 | 2.1 |
| Comparative Example 4 | Toner 32 | 1.43 | 1.22 | 0.21 | D | 0.8 | 1.5 |

TABLE 6

| (normal temperature/low humidity environment (23° C., 5% RH)) | | | | | | | |
|---|---|---|---|---|---|---|---|
| | | density | | density | evaluation | fogging | |
| | | print 1 | print 1000 | difference | rank | print 1 | print 1000 |
| Example 1 | Toner 1 | 1.40 | 1.38 | 0.02 | A | 0.1 | 0.1 |
| Example 2 | Toner 2 | 1.40 | 1.38 | 0.02 | A | 0.1 | 0.2 |
| Example 3 | Toner 3 | 1.40 | 1.37 | 0.03 | A | 0.1 | 0.2 |
| Example 4 | Toner 4 | 1.40 | 1.37 | 0.03 | A | 0.1 | 0.2 |
| Example 5 | Toner 5 | 1.40 | 1.37 | 0.03 | A | 0.1 | 0.2 |
| Example 6 | Toner 6 | 1.40 | 1.36 | 0.04 | A | 0.2 | 0.3 |
| Example 7 | Toner 7 | 1.40 | 1.36 | 0.04 | A | 0.2 | 0.3 |
| Example 8 | Toner 8 | 1.40 | 1.35 | 0.05 | B | 0.2 | 0.3 |
| Example 9 | Toner 9 | 1.40 | 1.35 | 0.05 | B | 0.2 | 0.3 |
| Example 10 | Toner 10 | 1.40 | 1.34 | 0.06 | B | 0.2 | 0.3 |
| Example 11 | Toner 11 | 1.40 | 1.33 | 0.07 | B | 0.2 | 0.3 |
| Example 12 | Toner 12 | 1.40 | 1.34 | 0.06 | B | 0.2 | 0.3 |
| Example 13 | Toner 13 | 1.40 | 1.34 | 0.06 | B | 0.2 | 0.3 |
| Example 14 | Toner 14 | 1.40 | 1.32 | 0.08 | B | 0.2 | 0.3 |
| Example 15 | Toner 15 | 1.42 | 1.35 | 0.07 | B | 0.3 | 0.3 |
| Example 16 | Toner 16 | 1.38 | 1.30 | 0.08 | B | 0.3 | 0.3 |
| Example 17 | Toner 17 | 1.38 | 1.30 | 0.08 | B | 0.3 | 0.3 |
| Example 18 | Toner 18 | 1.44 | 1.36 | 0.08 | B | 0.4 | 0.5 |
| Example 19 | Toner 19 | 1.47 | 1.39 | 0.08 | B | 0.4 | 0.5 |
| Example 20 | Toner 20 | 1.44 | 1.35 | 0.09 | B | 0.5 | 0.8 |
| Example 21 | Toner 21 | 1.45 | 1.36 | 0.09 | B | 0.4 | 0.5 |
| Example 22 | Toner 22 | 1.44 | 1.35 | 0.09 | B | 0.6 | 0.8 |
| Example 23 | Toner 23 | 1.40 | 1.32 | 0.08 | B | 0.4 | 0.5 |
| Example 24 | Toner 24 | 1.43 | 1.34 | 0.09 | B | 0.7 | 0.8 |
| Example 25 | Toner 25 | 1.46 | 1.34 | 0.12 | C | 0.7 | 0.8 |
| Example 26 | Toner 26 | 1.45 | 1.33 | 0.12 | C | 1.2 | 1.5 |
| Example 27 | Toner 27 | 1.35 | 1.22 | 0.13 | C | 0.6 | 0.9 |
| Example 28 | Toner 28 | 1.45 | 1.30 | 0.15 | C | 1.3 | 1.6 |
| Comparative Example 1 | Toner 29 | 1.30 | 1.18 | 0.12 | C | 0.4 | 1.1 |
| Comparative Example 2 | Toner 30 | 1.44 | 1.21 | 0.23 | D | 2.8 | 4.0 |

TABLE 6-continued

| (normal temperature/low humidity environment (23° C., 5% RH)) | | | | | | | |
|---|---|---|---|---|---|---|---|
| | | density | | density | evaluation | fogging | |
| | | print 1 | print 1000 | difference | rank | print 1 | print 1000 |
| Comparative Example 3 | Toner 31 | 1.52 | 1.35 | 0.17 | C | 2.1 | 3.8 |
| Comparative Example 4 | Toner 32 | 1.38 | 1.10 | 0.28 | D | 1.2 | 1.9 |

TABLE 7

| (high temperature/high humidity environment (32.5° C., 80% RH)) | | | | | | | |
|---|---|---|---|---|---|---|---|
| | | density | | density | evaluation | fogging | |
| | | print 1 | print 1000 | difference | rank | print 1 | print 1000 |
| Example 1 | Toner 1 | 1.50 | 1.49 | 0.01 | A | 0.2 | 0.2 |
| Example 2 | Toner 2 | 1.50 | 1.48 | 0.02 | A | 0.2 | 0.3 |
| Example 3 | Toner 3 | 1.50 | 1.47 | 0.03 | A | 0.3 | 0.3 |
| Example 4 | Toner 4 | 1.50 | 1.45 | 0.05 | B | 0.3 | 0.4 |
| Example 5 | Toner 5 | 1.50 | 1.44 | 0.06 | B | 0.3 | 0.3 |
| Example 6 | Toner 6 | 1.50 | 1.44 | 0.06 | B | 0.3 | 0.3 |
| Example 7 | Toner 7 | 1.50 | 1.43 | 0.07 | B | 0.3 | 0.4 |
| Example 8 | Toner 8 | 1.50 | 1.43 | 0.07 | B | 0.3 | 0.4 |
| Example 9 | Toner 9 | 1.50 | 1.43 | 0.07 | B | 0.3 | 0.4 |
| Example 10 | Toner 10 | 1.50 | 1.42 | 0.08 | B | 0.3 | 0.4 |
| Example 11 | Toner 11 | 1.50 | 1.41 | 0.09 | B | 0.3 | 0.5 |
| Example 12 | Toner 12 | 1.50 | 1.44 | 0.06 | B | 0.4 | 0.4 |
| Example 13 | Toner 13 | 1.50 | 1.43 | 0.07 | B | 0.4 | 0.4 |
| Example 14 | Toner 14 | 1.50 | 1.41 | 0.09 | B | 0.4 | 0.6 |
| Example 15 | Toner 15 | 1.52 | 1.45 | 0.07 | B | 0.4 | 0.6 |
| Example 16 | Toner 16 | 1.48 | 1.40 | 0.08 | B | 0.4 | 0.6 |
| Example 17 | Toner 17 | 1.47 | 1.39 | 0.08 | B | 0.4 | 0.6 |
| Example 18 | Toner 18 | 1.55 | 1.42 | 0.13 | C | 0.5 | 0.7 |
| Example 19 | Toner 19 | 1.58 | 1.45 | 0.13 | C | 0.5 | 0.7 |
| Example 20 | Toner 20 | 1.55 | 1.41 | 0.14 | C | 1.2 | 1.3 |
| Example 21 | Toner 21 | 1.55 | 1.41 | 0.14 | C | 0.7 | 0.9 |
| Example 22 | Toner 22 | 1.55 | 1.41 | 0.14 | C | 1.3 | 1.5 |
| Example 23 | Toner 23 | 1.50 | 1.32 | 0.18 | C | 0.8 | 0.9 |
| Example 24 | Toner 24 | 1.55 | 1.38 | 0.17 | C | 1.5 | 1.7 |
| Example 25 | Toner 25 | 1.47 | 1.28 | 0.19 | C | 1.5 | 1.7 |
| Example 26 | Toner 26 | 1.55 | 1.38 | 0.17 | C | 1.7 | 1.9 |
| Example 27 | Toner 27 | 1.45 | 1.29 | 0.16 | C | 1.5 | 1.7 |
| Example 28 | Toner 28 | 1.55 | 1.38 | 0.17 | C | 1.6 | 1.8 |
| Comparative Example 1 | Toner 29 | 1.40 | 1.18 | 0.22 | D | 0.5 | 1.2 |
| Comparative Example 2 | Toner 30 | 1.55 | 1.05 | 0.50 | D | 3.1 | 5.5 |
| Comparative Example 3 | Toner 31 | 1.60 | 1.06 | 0.54 | D | 4.2 | 4.8 |
| Comparative Example 4 | Toner 32 | 1.45 | 0.88 | 0.57 | D | 1.5 | 2.3 |

EXPLANATION OF REFERENCE SYMBOLS

100: toner particle feeding port
101: hot air current feeding port
102: air current spray member
103: cold air current feeding port
104: second cold air current feeding port
106: cooling jacket
114: toner particle
115: compressed air feeding nozzle
116: transport conduit

The invention claimed is:

1. A toner comprising toner particles, each of which contains a binder resin and a wax, and inorganic fine particles, wherein the binder resin contains a polyester resin A obtained by condensation polymerization of a polyvalent carboxylic acid and an alcohol component mainly containing an aromatic diol, and a polyester resin B obtained by condensation polymerization of a polyvalent carboxylic acid and an alcohol component mainly containing an aliphatic diol, and wherein the toner satisfies the following formula (1)

$$1.05 \leq P1/P2 \leq 2.00 \quad (1)$$

[in the formula (1), P1=Pa/Pb and P2=Pc/Pd]

wherein

Pa is the intensity of the highest absorption peak in the range from 2843 $cm^{-1}$ to 2853 $cm^{-1}$ in a FT-IR spectrum obtained by attenuated total reflectance (ATR) method by using Ge as the ATR crystal and under the condition of an infrared light-incidence angle of 45°, and Pb is the intensity of the highest absorption peak in the range from 1713 $cm^{-1}$ to 1723 $cm^{-1}$ in the FT-IR spectrum obtained by attenuated total reflectance (ATR) method by using Ge as the ATR crystal and under the condition of an infrared light-incidence angle of 45°, and wherein Pc is the intensity of the highest absorption peak in the range from 2843 $cm^{-1}$ to 2853 $cm^{-1}$ in a FT-IR spectrum obtained by attenuated total reflectance (ATR) method by using KRS5 as the ATR crystal and under the condition of an infrared light-incidence angle of 45°, and Pd is the intensity of the highest absorption peak in the range from 1713 $cm^{-1}$ to 1723 $cm^{-1}$ in the FT-IR spectrum obtained by attenuated total reflectance (ATR) method by using KRS5 as the ATR crystal and under the condition of an infrared light-incidence angle of 45°.

2. The toner according to claim 1, wherein the content ratio between the polyester resin A and the polyester resin B in the binder resin (A/B) is from at least 55/45 to not more than 90/10 on a mass basis.

3. The toner according to claim 1, wherein the polyester resin A has a softening point, measured using a constant load extrusion-type capillary rheometer, of from at least 70° C. to not more than 95° C., and wherein the polyester resin A has a hydroxyl value of from at least 30 mg KOH/g to not more than 90 mg KOH/g.

4. The toner according to claim 1, wherein the polyester resin B has a softening point, measured using a constant load extrusion-type capillary rheometer, of from at least 100° C. to not more than 150° C., and wherein the polyester resin B has a hydroxyl value of not more than 20 mg KOH/g.

5. The toner according to claim 1, wherein toner particles have been subjected to a surface treatment using a hot air current.

* * * * *